US006726034B2

(12) United States Patent
Holbrook et al.

(10) Patent No.: US 6,726,034 B2
(45) Date of Patent: Apr. 27, 2004

(54) FURNITURE SYSTEM

(75) Inventors: Richard M. Holbrook, Altadena, CA (US); Filiberto Betancourt, North Hills, CA (US); Jeffrey Bentzler, Los Angeles, CA (US); Darren Mark, Valencia, CA (US)

(73) Assignee: Teknion, LLC, Toronto (CA)

( * ) Notice: Subject to any disclaimer, the term of this patent is extended or adjusted under 35 U.S.C. 154(b) by 86 days.

(21) Appl. No.: 10/091,811

(22) Filed: Mar. 6, 2002

(65) Prior Publication Data

US 2003/0168951 A1 Sep. 11, 2003

(51) Int. Cl.[7] ..... A47F 5/00

(52) U.S. Cl. ..... 211/87.01; 211/94.02; 211/103; 211/90.02; 248/297.21; 312/245

(58) Field of Search ..... 248/222.12, 223.41, 248/297.21; 312/265.1, 245; 211/94.01, 94.02, 103, 87.01, 90.02

(56) References Cited

U.S. PATENT DOCUMENTS

| | | | | |
|---|---|---|---|---|
| 2,677,519 | A | | 5/1954 | Hobson |
| 3,513,606 | A | * | 5/1970 | Jones |
| 3,830,374 | A | * | 8/1974 | Kassimir |
| 4,345,849 | A | * | 8/1982 | Stenemann |
| 4,373,693 | A | | 2/1983 | Greenberger |
| 4,383,614 | A | | 5/1983 | Miller |
| 4,560,130 | A | | 12/1985 | Schwartz |
| 4,582,001 | A | | 4/1986 | Leikarts |
| 4,725,030 | A | | 2/1988 | Miller et al. |
| 4,895,331 | A | | 1/1990 | Nehls |
| 4,974,352 | A | * | 12/1990 | Chen |
| 5,011,323 | A | * | 4/1991 | Liuo |
| 5,142,832 | A | | 9/1992 | Branham, Sr. et al. |
| 5,241,451 | A | * | 8/1993 | Walburn et al. |
| 5,407,262 | A | | 4/1995 | Christian et al. |
| 5,695,263 | A | * | 12/1997 | Simon et al. ..... 312/265.1 X |
| 5,797,503 | A | | 8/1998 | Stevens et al. |
| 5,806,258 | A | | 9/1998 | Miedema et al. |
| 5,924,577 | A | | 7/1999 | Gessert |
| 5,941,399 | A | | 8/1999 | Wang |
| 6,052,958 | A | | 4/2000 | Miedema et al. |
| 6,074,029 | A | | 6/2000 | Snoke et al. |
| 6,119,317 | A | * | 9/2000 | Pfister ..... 248/223.41 |
| 6,142,322 | A | | 11/2000 | Smith et al. |
| 6,241,106 | B1 | | 6/2001 | Fujita et al. |
| 6,260,324 | B1 | | 7/2001 | Miedema et al. |
| 6,402,420 | B1 | * | 6/2002 | Yang |
| 6,554,235 | B1 | * | 4/2003 | Fortier |
| 6,612,664 | B2 | * | 9/2003 | Pryor et al. |

* cited by examiner

*Primary Examiner*—Robert W Gibson, Jr.
(74) *Attorney, Agent, or Firm*—Christie, Parker & Hale, LLP

(57) ABSTRACT

A modular furniture system having at least one rail that has a grooved surface, at least one clip adapted to cooperatively engage the grooved surface of the rail(s), a fastener for securing the clip(s) to the rail(s), and at least one fixture mounted over the clip(s) and onto the rail(s). The clip(s) have a first end and a second end opposite the first end, the first end having two arms facing each other separated by a channel. The arms are capable of being biased toward each other as the clip is inserted into the grooved surface and maintains the clip in the grooved surface after the clip is inserted. The fastener is dimensioned to pass into the channel to secure the clip(s) to the rail(s). Several fixtures can be used with the furniture system to provide a number of different configurations, including surface mounted furniture systems, mobile furniture systems, and furniture systems that are either integral parts of other pieces of furniture or stand alone systems.

29 Claims, 23 Drawing Sheets

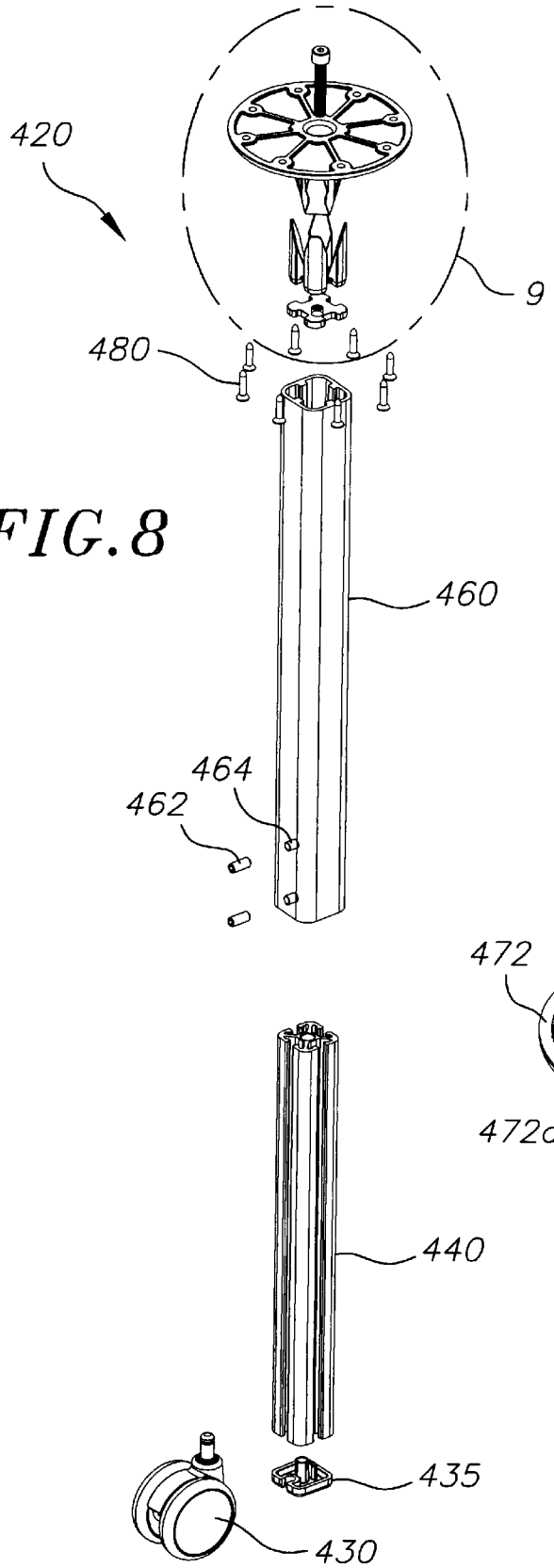
FIG. 8
FIG. 9
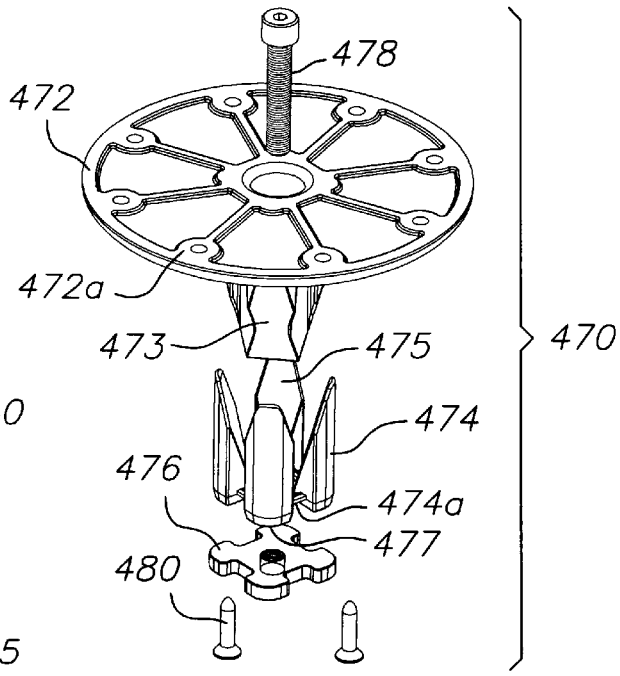

FURNITURE SYSTEM

FIELD OF THE INVENTION

The present invention relates to a modular furniture system that utilizes a novel clip design to allow for infinite adjustment and placement of components or fixtures within the furniture system. More particularly, the furniture system incorporates grooved rails which are adapted for receiving the clips which releasably lock within the groove to provide a support surface for the components or fixtures thereby providing for customization of the furniture system.

BACKGROUND OF THE INVENTION

Systems for arranging furniture and fixtures are well known, but often share the common drawback of being inconvenient to assemble and are limited in the number of configurations. For example, cabinet assemblies having vertically extending side support surfaces with multiple perforations or slots along the interior of the side surfaces allow for placement of fixtures such as shelving or drawers, but are limited in arrangement because of the fixed locations of the side surfaces and the slots. In addition, the means for attaching the fixtures to the support surfaces are often unable to withstand heavy loads and cannot be readily re-positioned without disassembling the entire system.

The use of rails having vertically extending grooves is also known for a variety of uses such as office furniture, home furnishings, or merchandising displays. The known systems, however, are lacking aesthetic appeal and convenience because the points of connection between components within the systems have visible physical fasteners and cannot be changed independently of other points of connection. For example, connections between grooved rails and fixtures have been accomplished by mounting a bracket between the lips of the grooved rails and then attaching the fixture to the bracket. The disadvantage of known brackets has been either the limitation of having to install the bracket from an end of the rail, or the limitation that the bracket is bulky and has multiple parts, such as buttons and springs. Accordingly, it is desirable to have a means for connecting a fixture to a rail that allows for installation of the connecting means at any point in the rail's groove, yet have a compact size and relatively few components.

Further disadvantages of rail-based assemblies have been the way that the rails connect to support surfaces, such as walls, and the way that the rails connect to other rails. Both types of connections have included use of fasteners that are visible and provide a non-uniform appearance. Accordingly, it is desirable to have a rail-based assembly that connects rails to support surfaces and other rails in a manner that appears to be a single, solid construction.

In addition to furniture systems that mount to support surfaces, it is also known to have mobile furniture systems. The same drawbacks that exist in the fixed, mounted furniture systems also exist in the known mobile systems. The means for connecting the frame and fixtures to one another has been limited in adjustment and are undesirable aesthetically because fasteners are physically visible and not easily moved. Thus, it is desirable to have a mobile furniture system that has aesthetic appeal, yet practical convenience in terms of assembly and arrangement.

The fixtures mounted in or about furniture systems, particularly rail-based furniture systems, have been lacking in versatility because the means for mounting to the rails are not uniform for all fixtures in the furniture system. For example, shelving or boxes or drawers have required the use of different brackets or fasteners for being connected to the rails. In addition, known fixtures have been difficult to mount and un-mount from the rails. Accordingly, it is desirable to have fixtures that are adapted to be easily mounted within a rail-based furniture system and can be interchanged with other fixtures of the furniture system by using the same connection means for mounting the fixtures to the rails.

SUMMARY OF THE INVENTION

The present invention overcomes the problems of existing modular furniture systems by providing for easy adjustment, assembly, and interchangeability of the components of the system. The present furniture system includes a modular furniture system having at least one rail that has a grooved surface with a pair of internal lips, at least one clip adapted to cooperatively engage the grooved surface of the rail(s), a fastener for securing the clip(s) to the rail(s), and at least one fixture mounted over the clip(s) and onto the rail(s).

The clip(s) have a distal end, a proximal end, and a central disc disposed between the distal and proximal ends. The distal end has two arms situated opposite each other and forming a channel therebetween, and the proximal end has a fixture holding rod with an internal passage extending through the central disc into the channel. The fastener is dimensioned to pass through the internal passage and the channel to secure the clip(s) to the rail(s). As the fastener passes through the channel the arms are radially expanded against the internal lips of the grooved surface of the rail, thereby fixing the position of the clip in the rial.

Several fixtures can be used with the furniture system to provide a number of different configurations. The various fixtures, such as storage boxes, drawers, shelves, hanging rods, work surfaces, and white boards/pin boards, can be used with surface mounted furniture systems, mobile furniture systems, and furniture systems that are either integral parts of other pieces of furniture or stand alone systems.

BRIEF DESCRIPTION OF THE DRAWINGS

FIG. 8 shows an exploded perspective view of a leg assembly.

FIG. 9 shows an exploded perspective view of a wedge-based locking mechanism of the leg assembly.

DESCRIPTION OF THE PREFERRED EMBODIMENTS

Figure 1:
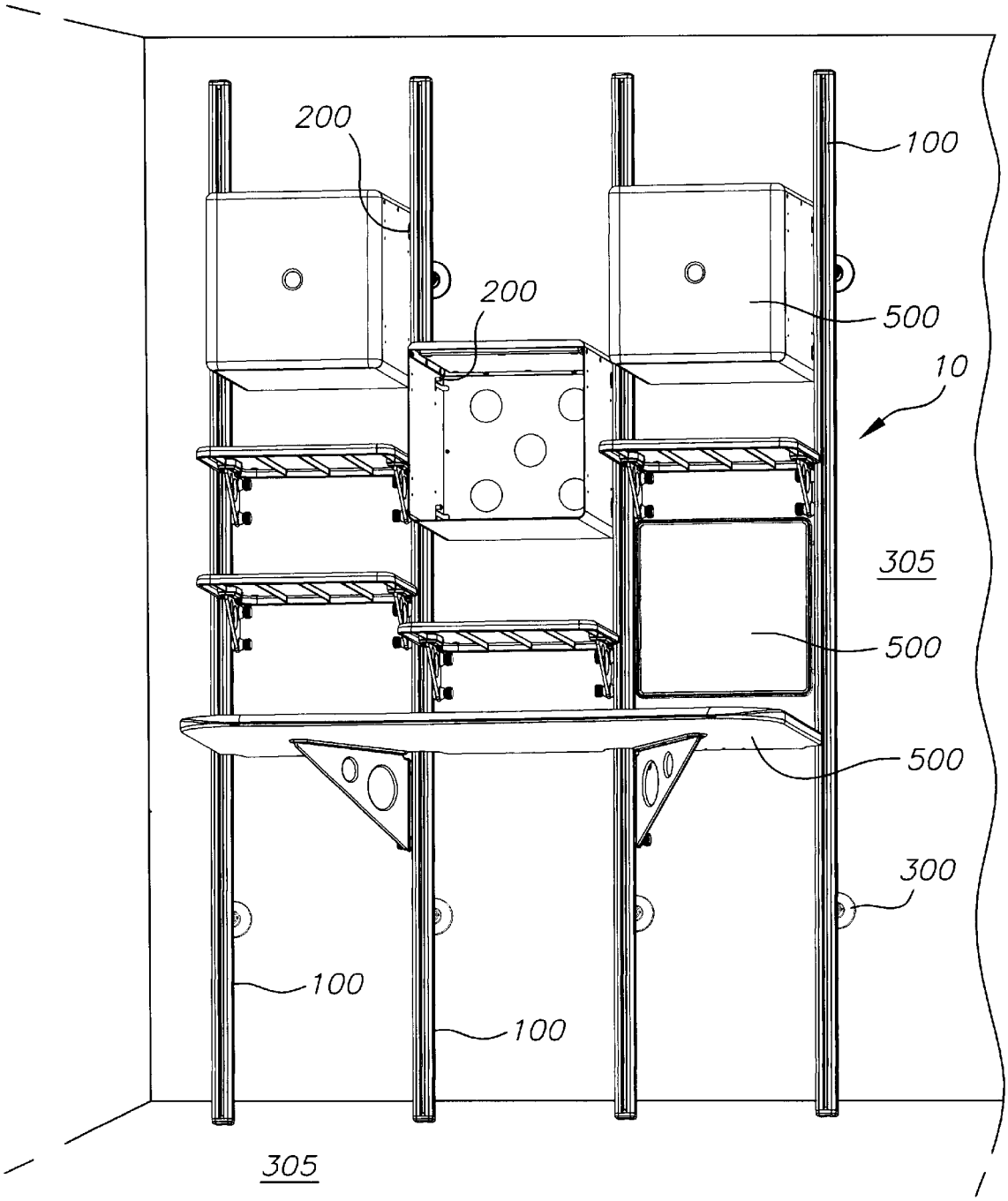
FIG. 1 shows a perspective view of a sample configuration of a surface mounted furniture system.
Figure 2:
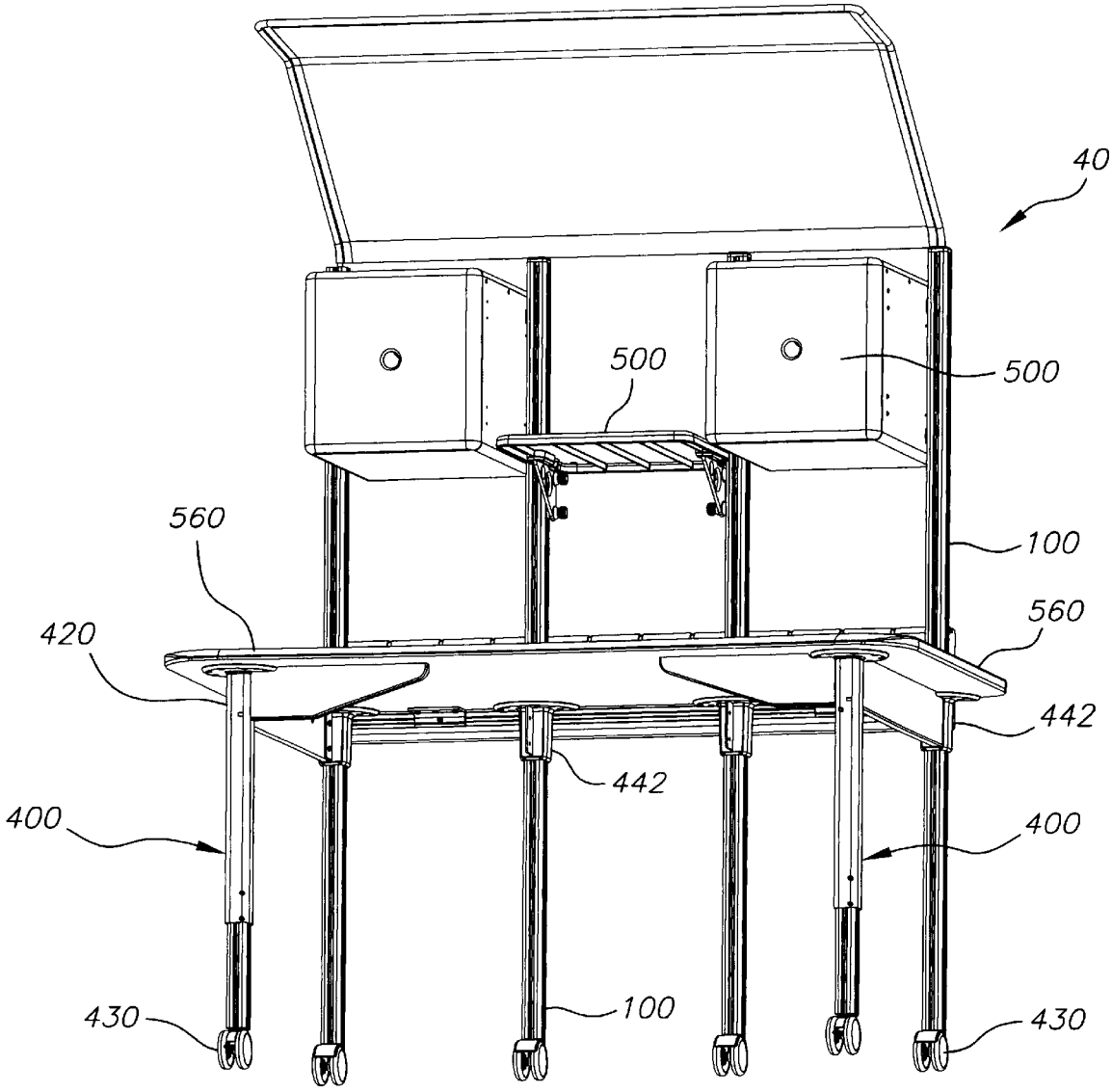
FIG. 2 shows a perspective view of a sample configuration of a mobile furniture system.
Figure 13:
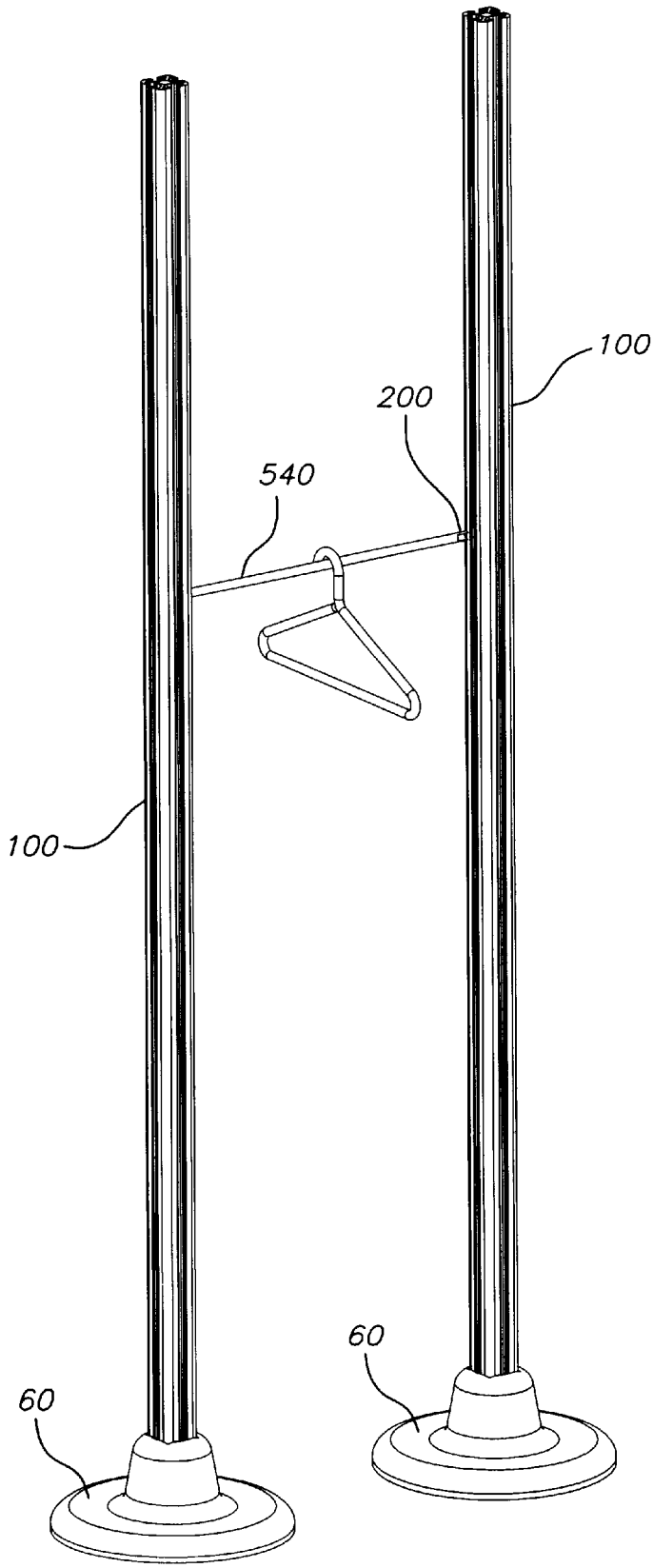
FIG. 13 shows a perspective view of a pair of rails mounted within base structures and supporting a hanging rod for use in merchandising display.

Referring now to FIG. 1, a sample configuration of the furniture system 10 of the present invention is shown. The furniture system 10 is shown as a surface mounted furniture system, but can also be configured as a mobile furniture system 40, which is shown in FIG. 2 and discussed below, or as an integral part of another piece of furniture, such as a cabinet, or as a stand alone system. The furniture system 10 includes one or more grooved rails 100 (four are shown by way of example) that are adapted to receive clips 200 which provide a means for connecting one or more fixtures 500 to the rails 100. In FIG. 1, all fixtures are labeled with reference numeral "500," but as will be discussed below, there are several fixtures that fall within the "fixtures 500" designation, and each fixture has its own reference numeral. For the surface mounted furniture system 10 shown in FIG. 1, a surface mount assembly 300 is used to secure the rails 100 to a support surface 305. In the embodiment shown in FIG. 1, the support surface 305 is a wall, and if also desired a floor. For the mobile furniture system 40 shown in FIG. 2, a leg assembly 400 is also used to support the rails 100 and fixtures 500. It is also contemplated that the furniture system 10, namely the rails 100, clips 200, and fixtures 500 can be fixed within a structure. For example, in a structure such as a cabinet or bookshelf the rails can be placed within the structure or made as an integral part of the structure. Further, it is contemplated that the present furniture system can be useful with neither the surface mount assembly 300 nor the leg assembly 400, by using some form of a base structure 60. As shown in FIG. 13, the rails 100, clips 200, and fixtures 500 are used with the base structure 60, wherein the rails are mounted within the base structure such that the rails and fixtures are sturdily supported without needing to be surface mounted or on legs.

Figure 3:
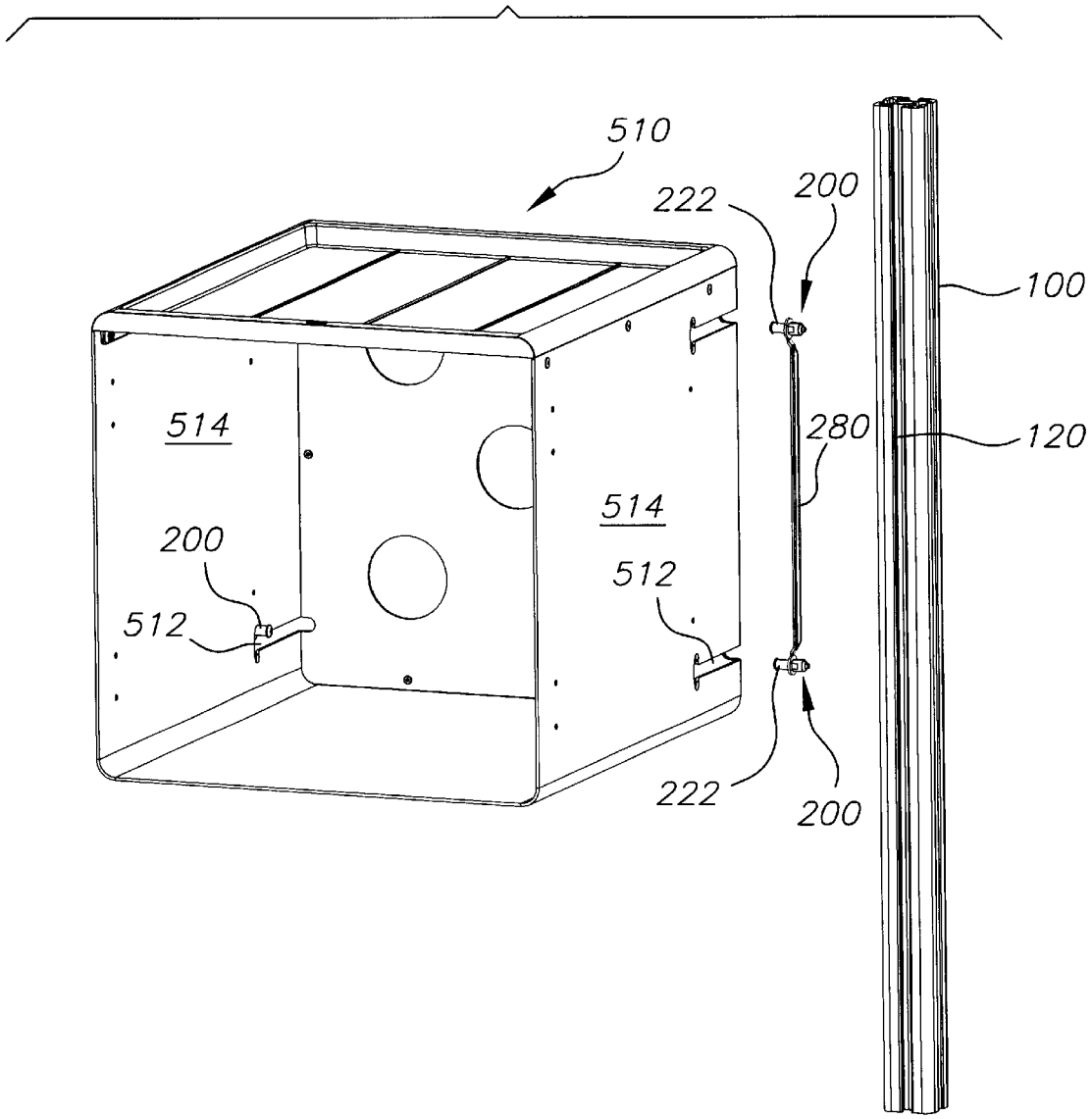
FIG. 3 shows perspective view of a rail, a clip, and a storage box in positions prior to combination of the three components.

Referring to FIG. 3, the rails 100 contain at least one groove 120, depending on the surface upon which fixtures will be secured to the rails. For the surface mounted furniture system 10 shown in FIG. 1, the rails preferably have at least two elongated grooves 120, wherein one of the grooves is used to accommodate the surface mount assembly 300 for securing the rail to the support surface 305, and the other groove 120 is used to accommodate one or more clips 200 for mounting one or more fixtures 500. The rails 100 generally have a much greater length than width, wherein the grooves 120 extend along the length of the rails. The rails can be positioned, however, either vertically or horizontally, and can also have a number of different cross-sectional configurations, such as being generally square, circular, triangular, hexagonal, etc.

Figure 4:
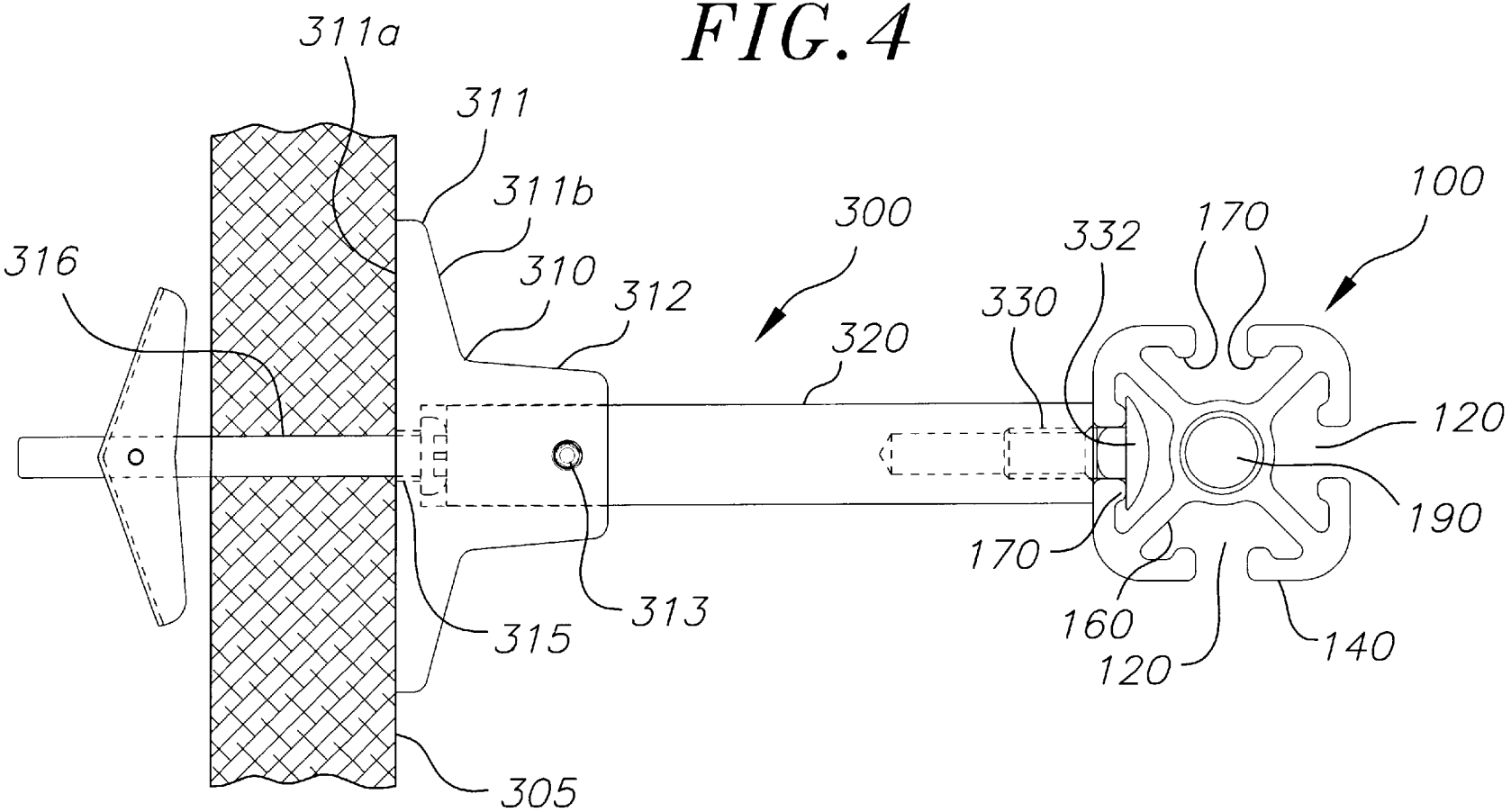
FIG. 4 shows a top perspective view, with hidden lines, of the rail being secured to a support surface by a surface mount assembly.

The rails 100, shown in more detail in FIGS. 3 and 4, have for example, a generally square cross-sectional configuration and are positioned vertically so that the grooves 120 extend vertically along the length of the rails. Further, the rails 100 have four identical sides, and as shown in FIG. 4, each side comprises a groove 120, an exterior surface 140, an interior surface 160, a pair of internal lips 170, and a center extrusion 190. Constructing rails 100 with four identical sides allows any of the four sides to be used as a mounting surface and, thus, simplifies assembly of the furniture system. As noted above, however, this feature is not required for assembly of the system. The material used to construct the rails 100 is preferably aluminum, but can be any material suitable for supporting a load, such as iron, steel, wood, and even a durable polymer or composite. The rails 100 are intended to provide support for accommodating a variety of different fixtures 500, such as a storage box 510, a drawer 520, a shelf 530, a gusset 535, a hanging rod 540, a white board or pin board 550, and a working surface 560 (collectively referred to as "fixtures 500").

The connection between most of the fixtures 500 and the rails 100 can be achieved by using clips 200, and with certain other fixtures the connection can be achieved by directly connecting the fixture to the rail by integral connectors on the fixture itself. The type of fixture mounted onto a rail 100 or between a plurality of rails 100 is sized relative to the rails and to the means for securing the fixture to the rails, often the clips 200. In other words, rails, clips, and fixtures can be scaled in size relative to one another depending on the application of the furniture system. Although no precise proportionality is required, it is generally anticipated that larger rails and clips will be required to accommodate larger fixtures. For example, two rails 100 intended to accommodate a shelf for holding books or pictures would be smaller in size and require smaller clips 200 than would rails intended to accommodate heavy machinery such as automobile engines.

Figure 5:
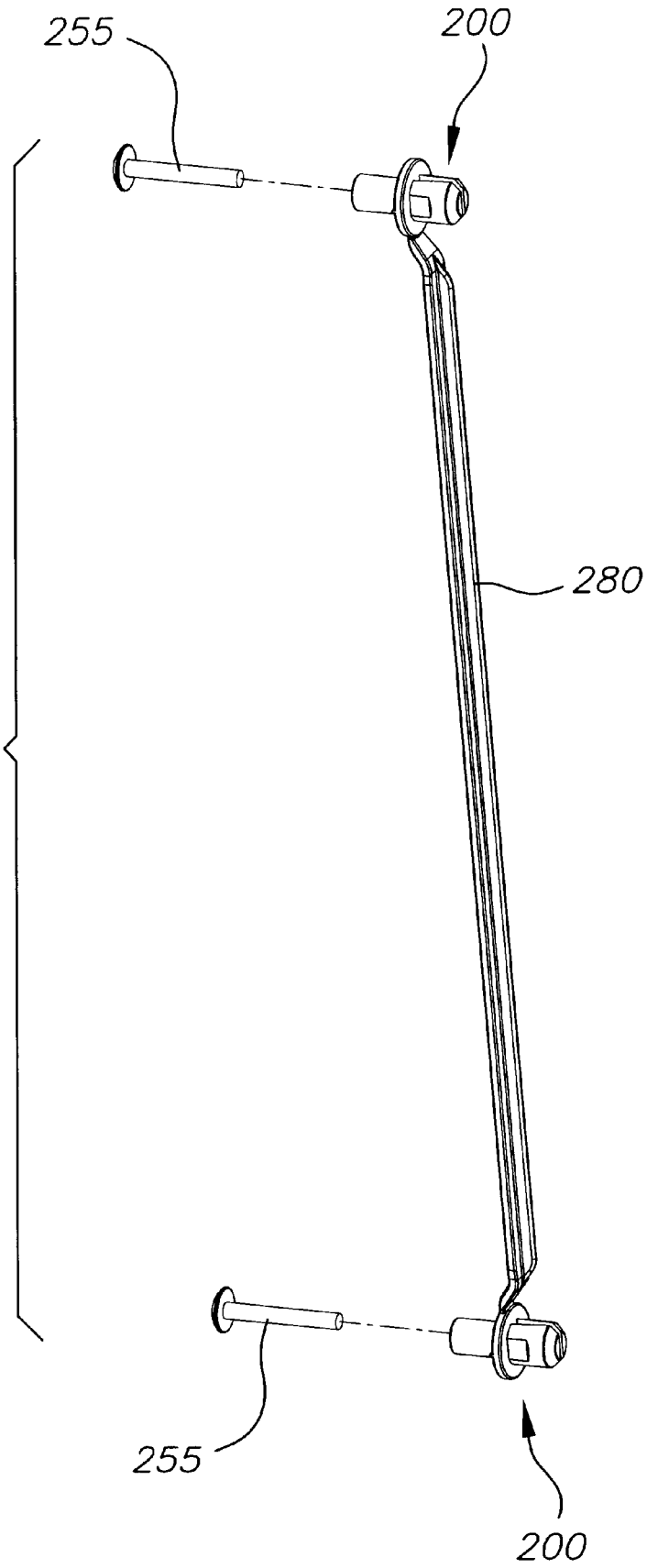
FIG. 5 shows a perspective view of two clips connected by a spacer.
Figure 6:
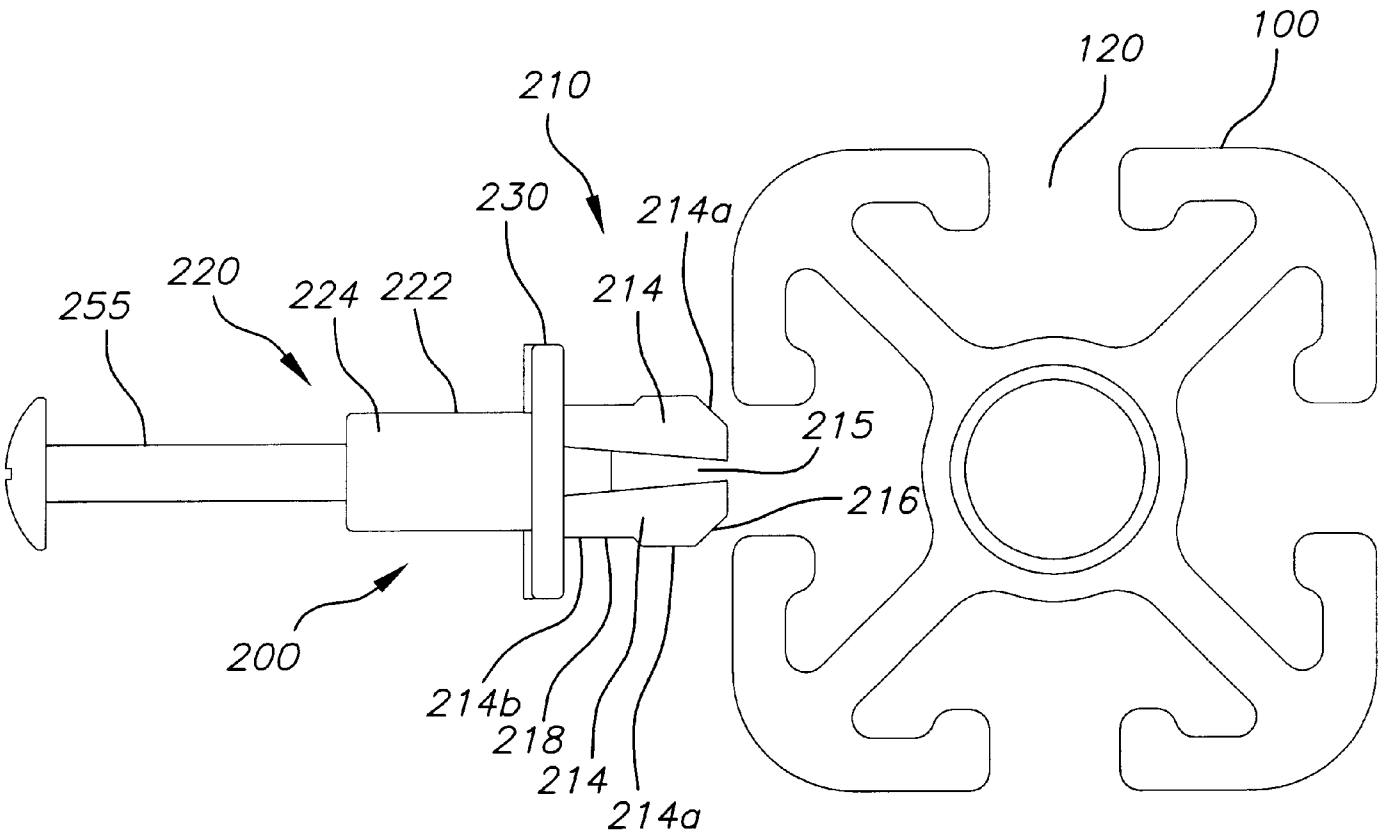
FIG. 6 shows a top perspective view of the clip in a position prior to being inserted into the rail.
Figure 7:
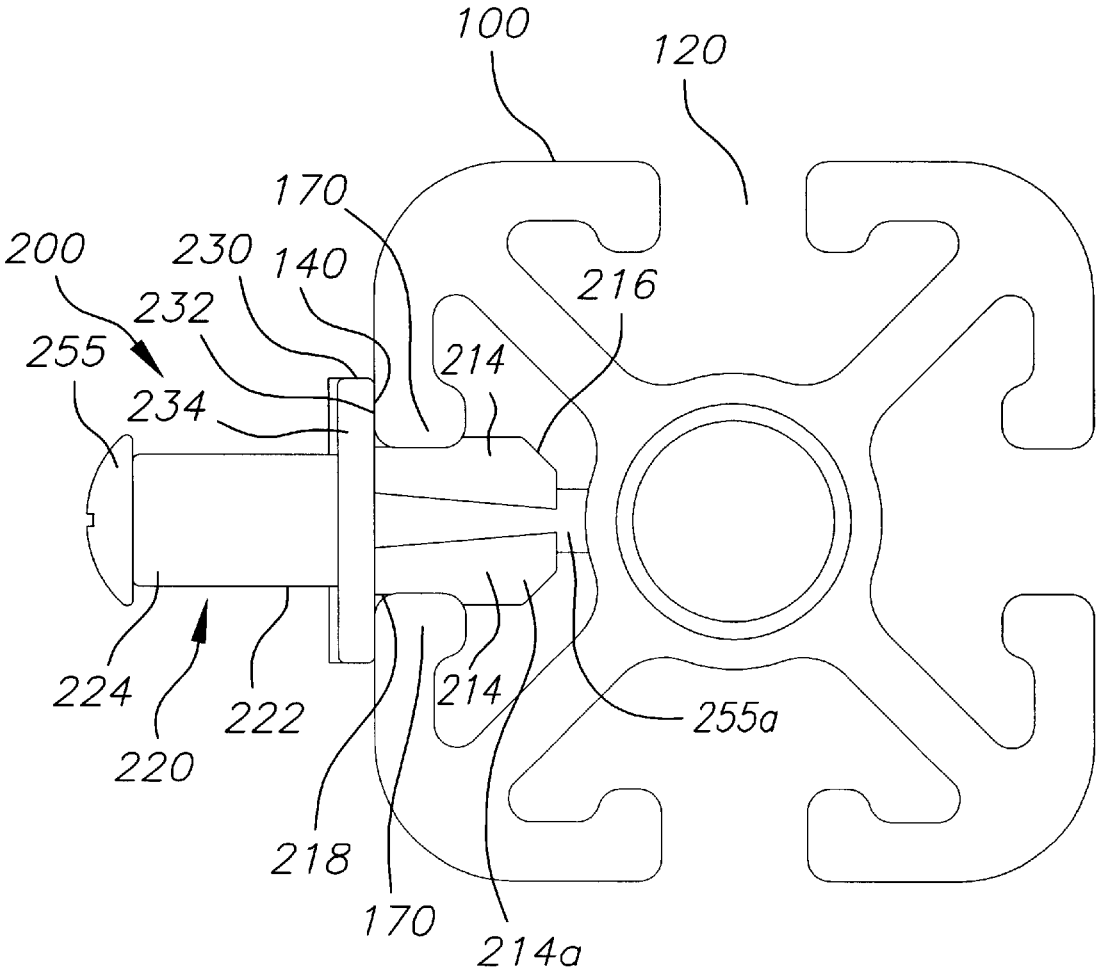
FIG. 7 shows a top perspective view of the clip inserted into the rail and secured within the rail by a set screw.

The presently preferred clip 200 is shown in FIGS. 5, 6, and 7. The clips 200 are designed to be positioned within the grooves 120 of rails 100. Unlike traditional clips or brackets used with grooved rails, the present clip 200 can be installed along any point in the groove 120, not just at the end surfaces. This provides greater flexibility in designing the furniture system of the present invention because it is easy to remove one fixture without having to remove another fixture positioned above or below the fixture.

Clip 200 preferably has a generally cylindrical shape comprising a distal end 210, a proximal end 220, and central disc 230 between the proximal and distal ends. The clip 200 is shown (FIG. 6) with a set screw 255 partially engaged through the proximal end and into a portion of the distal and of the clip. The distal end 210 is designed to cooperatively engage with groove 120 of rail 100. The distal end serves as an anchor and comprises two half cylindrical arms 214 situated opposite each other and defining a channel 215 therebetween. The diameter of channel 215 gradually increases in the proximal direction until reaching the central disc 230 where the two arms join the disc. The arms 214 further comprise a first portion 214*a* and second portion 214*b*, wherein the first portion has a tapered end surface 216 and the second portion has a shoulder 218. The first portion is larger in diameter than the second portion.

The arms 214 are partially compressible and positively biased so that the opposing arms can be compressed at the first portion 214*a* in order to be inserted into the groove 120 of rail 100. The tapered end surface 216 of the first portion of each arm guides the clip 200 into the groove of the rail, wherein applying insertion force will cause the arms to compress towards the channel 215. As shown in FIG. 7, after inserting clip 200 into groove 120 of rail 100, the shoulders 218 of the second portion of each arm 214 rests against the internal lips 170 of rail 100. Because the arms are positively biased and the shoulders 218 are indentations in the arms, the arms do not remain completely compressed after being inserted into the groove of the rail, but rather expand radially outward toward the internal lips 170 of the rail to create a friction fit. However, the clip 200 can still be moved within the groove in the direction of the groove. Because the shoulder 218 is preferably only machined along one surface of the arm, as opposed to around the entire arm surface, the clip cannot be rotated 360° within the groove. As explained below, the clip 200 is shown with the set screw 255, fully inserted to the clip, which means the position of the clip in the rail is fixed.

After inserting the distal end of the clip into the rail, the central disc 230 rests against the exterior surface 140 of the rail at a distal surface 232 of the central disc. Opposite the distal surface 232 of the central disc 230 is a proximal surface 234. The central disc 230 serves as a stop to prevent further insertion of the clip 200 into groove 120 of rail 100.

Referring to FIGS. 5 to 7, the proximal end 220 of clip 200 extends outward from the proximal surface 234 of central disc 230. The proximal end 220 comprises a fixture holding rod 222 for holding fixtures 500 between rails 100. The fixture holding rod 222 further comprises a hollow cylinder 224 defining an internal passage 225. The internal passage 225 extends from the proximal end 220 of the clip through the central disc 230 and ends at the channel 215 between arms 214. The internal passage is adapted to receive a fastener, such as set screw 255, which upon rotating will pass through the internal passage towards the channel 215. The fastener or set screw should have a length sufficient to extend in the channel 215, and can be a self-tapping screw or threaded depending on whether it is desired to have the internal passage 225 threaded to receive the set screw. As the set screw continues to travel in the distal direction it passes through channel 215. The diameter of channel 215, however, narrows in the distal direction towards the first portion 214*a* of arms 214. Accordingly, as shown in FIG. 7, as the set screw continues to be rotated through internal passage 225, the distal end 255*a* of set screw 255 pushes against the surfaces of the arms 214 that form channel 215. Due to the configuration of the channel 215 and arms 214, the set screw causes arms 214 to expand radially outward against internal lips 170 of rail 100. The arms 214, including shoulders 218 are pressed against groove 120 of rail 100, particularly the internal lips 170, such that clip 200 is locked at a point on rail 100. The clip can be removed from the rail by removing the set screw 255 from the internal passage 225, thereby causing arms 214 to return to their non-expanded position, which allows the clip to be forcibly pulled out of the groove 120.

When clip 200 is locked onto the rail 100, the fixture holding rod 222 is capable of supporting a load. Particularly, the fixture holding rod is specially adapted to fit within notches that are machined into fixtures 500. For example, as shown in FIG. 3, storage box 510 has notches 512 machined into both of its side surfaces 514, which allows the storage box to be mounted over the fixture holding rods 222 that extend outward from the opposing rails 100 (only one rail is shown). An example of various fixtures 500 mounted between opposing rails is shown in FIG. 1, wherein it is to be understood that clips 200 are cooperatively engaged with two rails 100 and fixture holding rods 222 are disposed within the notches in the fixtures.

Another feature available for clips 200 is to have more than one clip 200 connected by a spacer 280. This is shown in FIGS. 3 and 5. The spacer 280 is an optional feature that attaches the clips 200 together at a distance apart that allows for easy installation of the clips into the rails. Typically, the length of the spacer 280 will be made to approximate the distance that notches 512 in the fixtures being mounted are spaced apart, so that a user does not have to measure the distance for spacing the clips that will be attached to the rails.

The presently preferred clip 200 is formed from a single piece of injection molded plastic. The clip 200 can be made, however, from several different materials, such as any semi-flexible metal or plastic, and can have a wide variety of different sizes and configurations. For example, the clip does not need to be generally cylindrical in shape, but rather can also be generally square, hexagonal, or any other shape that allows the clip and rail to cooperatively engage.

As mentioned above, the furniture system of the present invention can be either surface mounted, mobile, an integral part of a different structure or mounted to a base structure. The surface mounted furniture system 10 requires a surface mount assembly to attach the rails 100 to a support surface. A preferred surface mount assembly 300 is shown in FIG. 4, and substantially comprises a mounting flange 310, a stand-off 320, and a fastening bolt 330. The surface mount assembly 300 is shown in combination with other components of the furniture system 10 in FIG. 1. Generally, as shown in FIG. 4, the mounting flange 310 is secured to the support surface 305, the fastening bolt 330 is disposed within the groove 120 of rail 100 and covered by the stand-off 320, wherein the stand-off 320 is thereby positioned between rail 100 and mounting flange 310.

The preferred surface mount assembly 300 creates a connection between rails 100 and the support surface 305 in a manner where no fasteners are readily visible. The mounting flange 310 comprises a base 311 having a mounting surface 311*a* and a supporting surface 311*b*. The mounting surface 311*a* is substantially flat and intended to mount against a substantially flat support surface 305. The supporting surface 311*b* tapers outward and forms into a hollow protruding cylinder 312 which extends outward a distance sufficient to receive the stand-off 320. The hollow protruding cylinder 312 continues until it abuts the base 311. The base also comprises a through hole 315 which extends through the mounting surface 311*a* and continues into the open area of the hollow protruding cylinder 312.

The mounting flange 310 is secured to the support surface by placing the mounting surface 311*a* of the base 311 against the support surface, and then positioning a fastener 316 through the opening of the hollow protruding cylinder 312. The fastener 316 can be any type of screw or wall anchor fastener, such a toggle bolt, wood screw, or concrete anchor. After being secured to the support surface the fastener will be disposed within the mounting flange and not visible. The connection between the mounting flange and rail is accomplished by disposing the stand-off 320 through the hollow protruding cylinder 312 and then setting the stand-off in place by disposing a set screw (not shown) through a small aperture 313 in the bottom of the hollow protruding cylinder. Prior to inserting the stand-off through the mounting flange, it is preferable to have secured the stand-off and fastening bolt 330 to the rail 100. The fastening bolt 330 matingly engages the internal surface of the stand-off 320, and the head portion 332 of the fastening bolt is sized to be disposed through the groove 120 of rail 100 by positioning the fastening bolt from an end surface of the rail. Once the placement of the rail has been determined, the stand-off is tightened over the fastening bolt, thereby securing the stand-off to the rail, and the stand-off is then mounted in the mounting flange.

It is understood that alternative surface mount assemblies can be used to secure the rails 100 to a support surface, but the presently preferred assembly provides structural integrity and effectively conceals all fasteners. Furthermore, the surface mounted system can have the rails 100 secured to additional support surface. For example, in addition to having the rails secured to the support surface 305 or a wall, the rails can also be supported by a support surface such as a floor. In such a configuration, the bottoms of rails would rest against the floor, allowing much of the weight of the surface mounted system to be borne by the floor, thus greatly increasing the relative strength of the system.

The mobile furniture system 40, shown in FIG. 2, represents an embodiment where the furniture system includes, amongst other fixtures 500, a working surface 560 as a fixture. This embodiment illustrates four rails 100, but a mobile furniture system can be formed with any number of rails exceeding two, or even a single curved rail that has two opposing surfaces. The mobile furniture system 40 requires a leg assembly 400 to support the rails 100 and fixtures 500, particularly working surface 560. The leg assembly 400 serves as front legs to the mobile furniture system because (as seen in FIG. 2) the rear legs are the rails 100. The leg assembly 400 is specially designed to provide a strong connection with the bottom surface of the work surface 560.

As shown in FIG. 8, the leg assembly 400 comprises at least one leg 420, wherein each leg 420 comprises a leg attachment mechanism such as wedge-based locking mechanism 470, a tube 460, and a leg base 440. The wedge-based locking mechanism comprises a leg flange 472, a plurality of wedges 474, a nut plate 476, and a screw 478. The wedge-based locking mechanism is inserted as a single unit into the leg tube 460, and after the locking mechanism and leg tube are effectively locked together, this combined assembly is mounted to the bottom of the working surface 560 by securing a plurality of fasteners 480 through apertures in the leg flange 472. Referring to FIG. 9, the assembly of the locking mechanism 470 comprises the leg flange 472 having a base 472*a* for attaching the leg flange to the bottom of the working surface 560, and tapered surfaces 473 which are adapted to accommodate the interior surfaces 475 of the wedges 474, and the nut plate 476 rests against the bottom surfaces 477 of the wedges 474 so that the wedges are held against the leg flange. The nut plate is held in place by the screw 478 which passes through the leg flange and the nut plate, wherein rotation of the screw causes the nut plate to be drawn towards the leg flange, thereby causing the wedges to be drawn against the tapered surface 473 of the leg flange.

The wedges 474 can be interconnected in a desired configuration by a plurality of webs 474*a*. The webs 474*a* are designed to break when exposed to a predetermined force, preferably the force equal to hand force with a hex wrench. Rotation of the screw 478 does not occur until the assembled locking mechanism 470 has been placed within the hollow portion of leg tube 460. Once rotation of the screw takes place, the nut plate is drawn upward towards the leg flange and the wedges 474 are equally drawn against the leg flange so that the wedges are forcibly engaging the interior surface of the leg tube 460, thereby securely locking the locking mechanism 470 within the leg tube 460.

The leg tube 460 receives the locking mechanism 470 and the leg base 440. The leg base 440 can be designed to match the exterior appearance of the rails 100, and connects to the leg tube by placing set screws 462 through adjustment holes 464 in the leg tube. The leg tube and leg base are telescopically connected so that the height of the leg 420, and consequently the height of the work surface 560, can be adjusted by changing the distance that the leg base 440 is inserted into the leg tube 460. The locking mechanism 470, leg tube 460, and leg base 440 attach to the bottom of the work surface 560 through the leg flange 472, and the bottom of the leg 420 can have either a caster 430 or a glide 435 (both shown in FIG. 8) which rests between the leg and the floor/bottom support surface.

Figure 10:
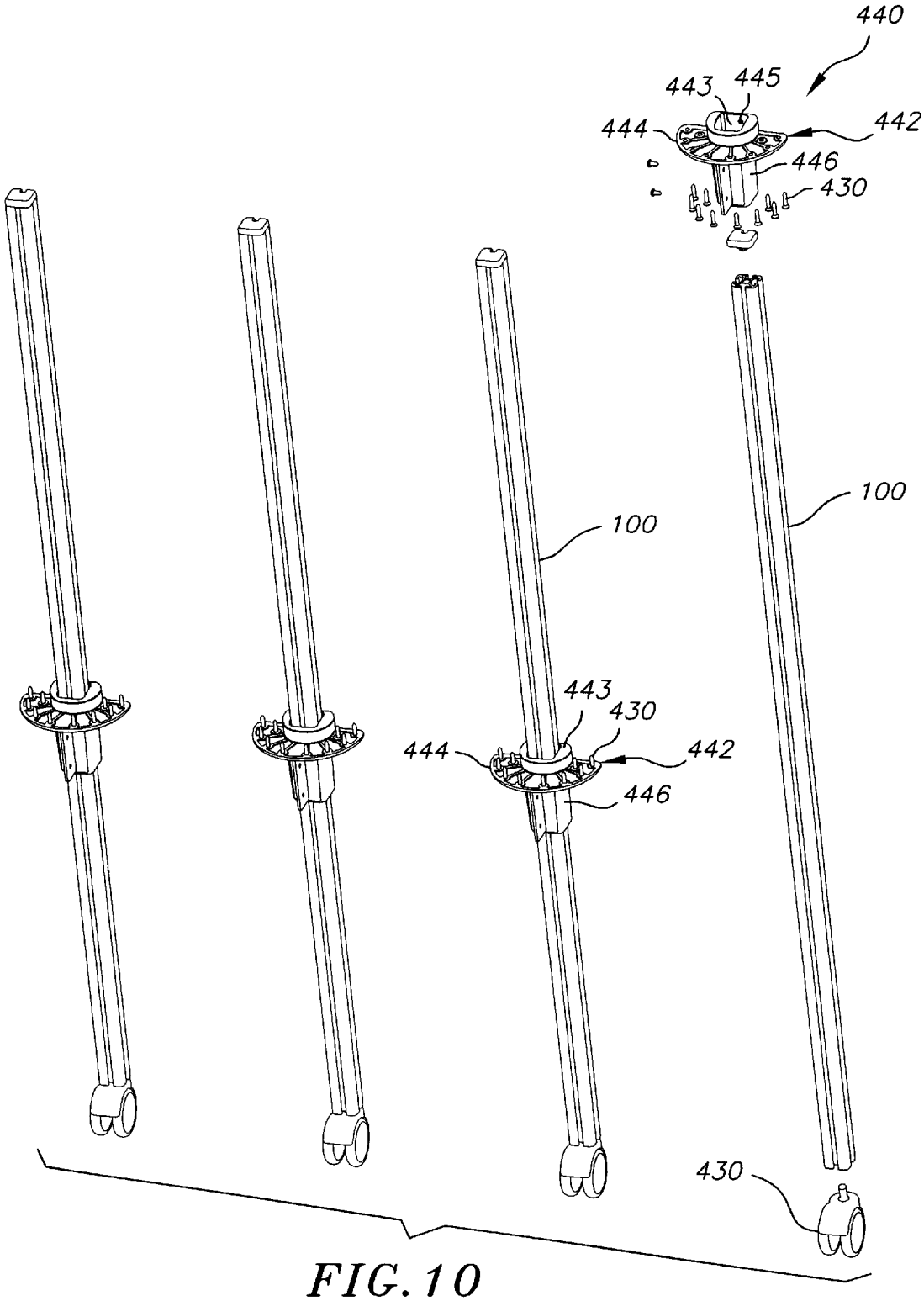
FIG. 10 show a exploded perspective view of a leg carriage and the rail.

Referring to FIG. 10, the rear legs of the mobile furniture system, which are the rails 100, connect to the work surface 560 by a leg carriage 442, which mounts over the rails 100 and secures to the work surface 560 (as shown in FIG. 2). The leg carriage 442 comprises a rail channel 443 that is sized to slidably receive the rails 100, a mounting plate 444, and a casing 446. The mounting plate 444 is preferably in the shape of a half circle and is adapted to mount substantially flush against the bottom surface of the work surface after a plurality of fasteners 430 are placed through holes in the mounting plate. The casing 446 surrounds the rail when the rail is disposed through channel 443, and further comprises at least one aperture 445. The aperture 445 is preferably positioned in the back facing surface of the casing 446 so that a set screw can be placed through the aperture to secure the leg carriage 442 to the rail 100 without any fasteners being readily visible.

The ability to use the features of the present invention as part of a separate structure, rather than being surface mounted or mobile, is understood because the rails 100, clips 200, and various fixtures 500 can be built into a pre-fabricated structure or installed into a solid, movable base, structure wherein the rails would simply extend upwards from the bottom base (as shown in FIG. 13). In such applications of the present invention, the advantages achieved by the rails, clips, and fixtures would not be diminished.

Figure 11:
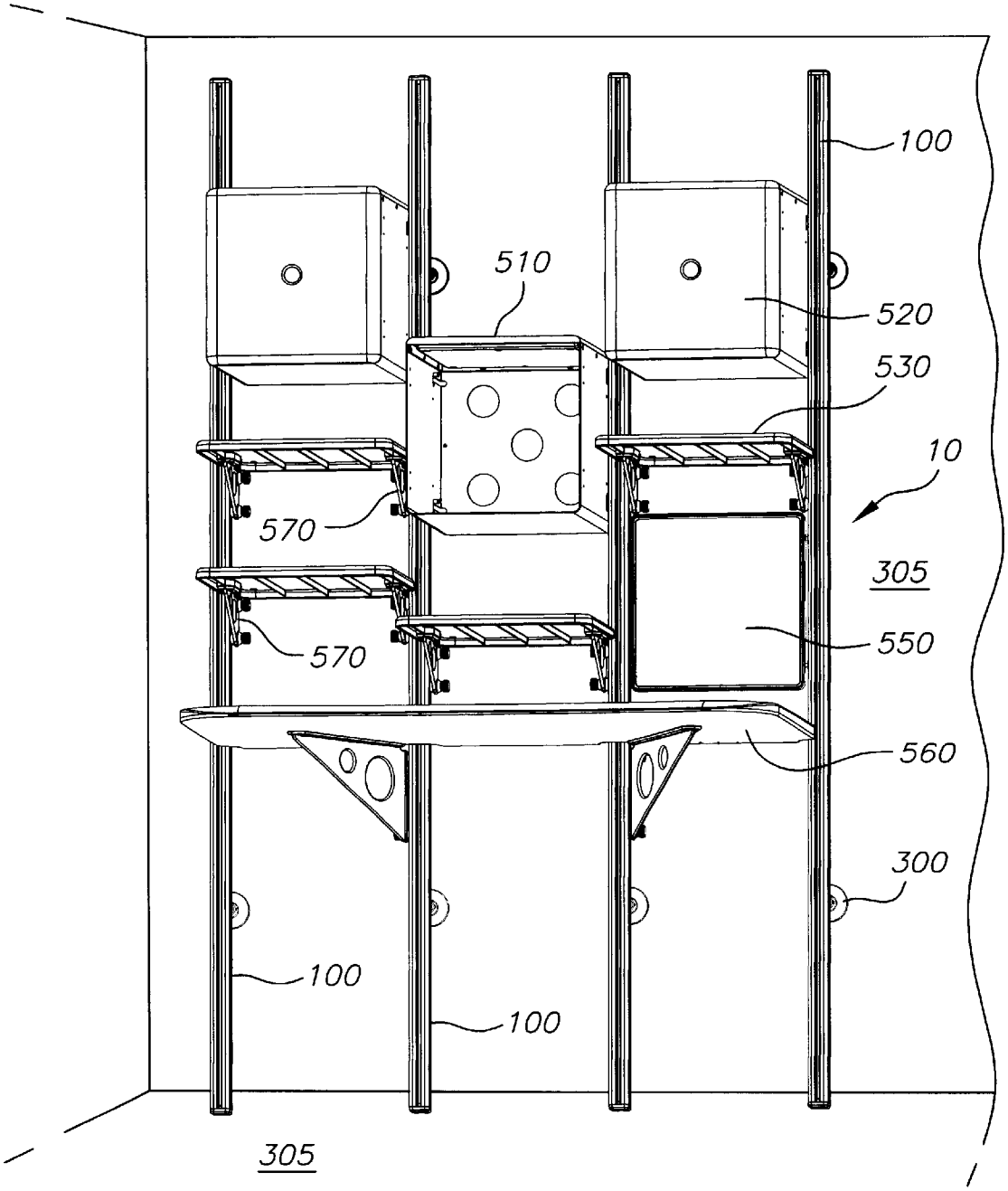
FIG. 11 shows a perspective view of the sample configuration of the surface mounted furniture system shown in FIG. 1, with the various fixtures labeled with different reference numerals.
Figure 12:
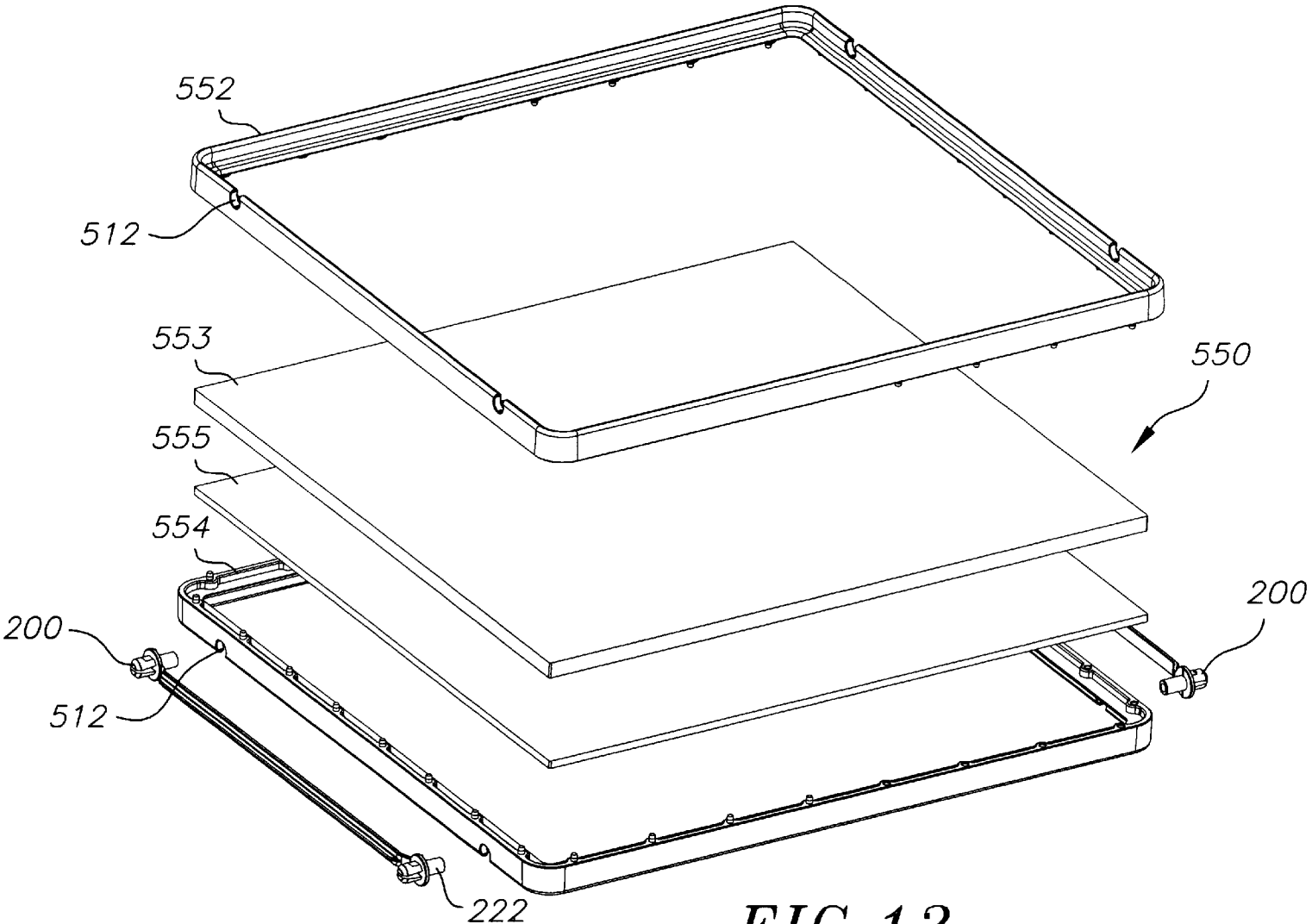
FIG. 12 shows an exploded perspective view of a white board/pin board positioned above a pair of clips.

With respect to the various fixtures 500 that can be used with the different embodiments of the present furniture system, many advantages are achieved by the clips 200, which allow for simple connection to both the rails 100 and the fixtures 500. There are numerous types of fixtures that fall within the group "fixtures 500." Several different fixtures are shown in FIG. 11, including storage boxes 510, drawers 520, shelves 530, gussets 570, white board/pin boards 550, and the working surface 560. These fixtures have notches 512 which cooperatively join the fixture holding rods 222 of clips 200. The notches 512 can have various configurations for different fixtures, such as the bayonet shape notch 512 shown in FIG. 3 that is part of storage box 510, and the notches 512 shown in Fig. 12 that are part of the white board/pin board 550. The white board/pin board 550 comprises a first frame 552 and second frame 554, wherein a writeable surface 553 and/or a pinnable surface 555 are mounted between the first and second frames, such that the combined components of the white board/pin board allow the fixture to be mounted over the clips 200. Further, the construction of the notches 512 on the first and second frame enables either the writable surface 553 or the pinnable surface 555 to be exposed towards a user of the furniture system when the white board/pin board is mounted within the rails. The notches allow the white board/pin board to be snapped over the clips 200. Depending on the particular fixture, the notches 512 allow fixtures to be mounted to a single rail 100, or between two or more opposing rails 100, by simply guiding the fixture over the fixture holding rods 222 which are extending outward from the rails 100.

As shown in FIG. 13, the hanging rod 540 also has notches 512 that mount over the clips, as well as a practical construction that works well with the present furniture system when it is used as a merchandising display system, particularly a clothing display. The hanging rod 540 can have a wide range of configurations, so long as it is has notches 512 to connect with the rails 100 and support a load. The hanging rod should be dimensioned to have a diameter that accommodates hangers regularly used by stores and individuals to hang clothing. The hanging rod 540 can have a predetermined, fixed length that allows the hanging rod to be positioned between opposing grooves 120 of one or more rails 100, by being mounted over the clips 200. Also, the hanging rod can be made adjustable in length by making the hanging rod out of two or more pieces, such that the two or more pieces telescopically connect in a way that makes the length of the hanging rod easily adjustable.

Figure 14:
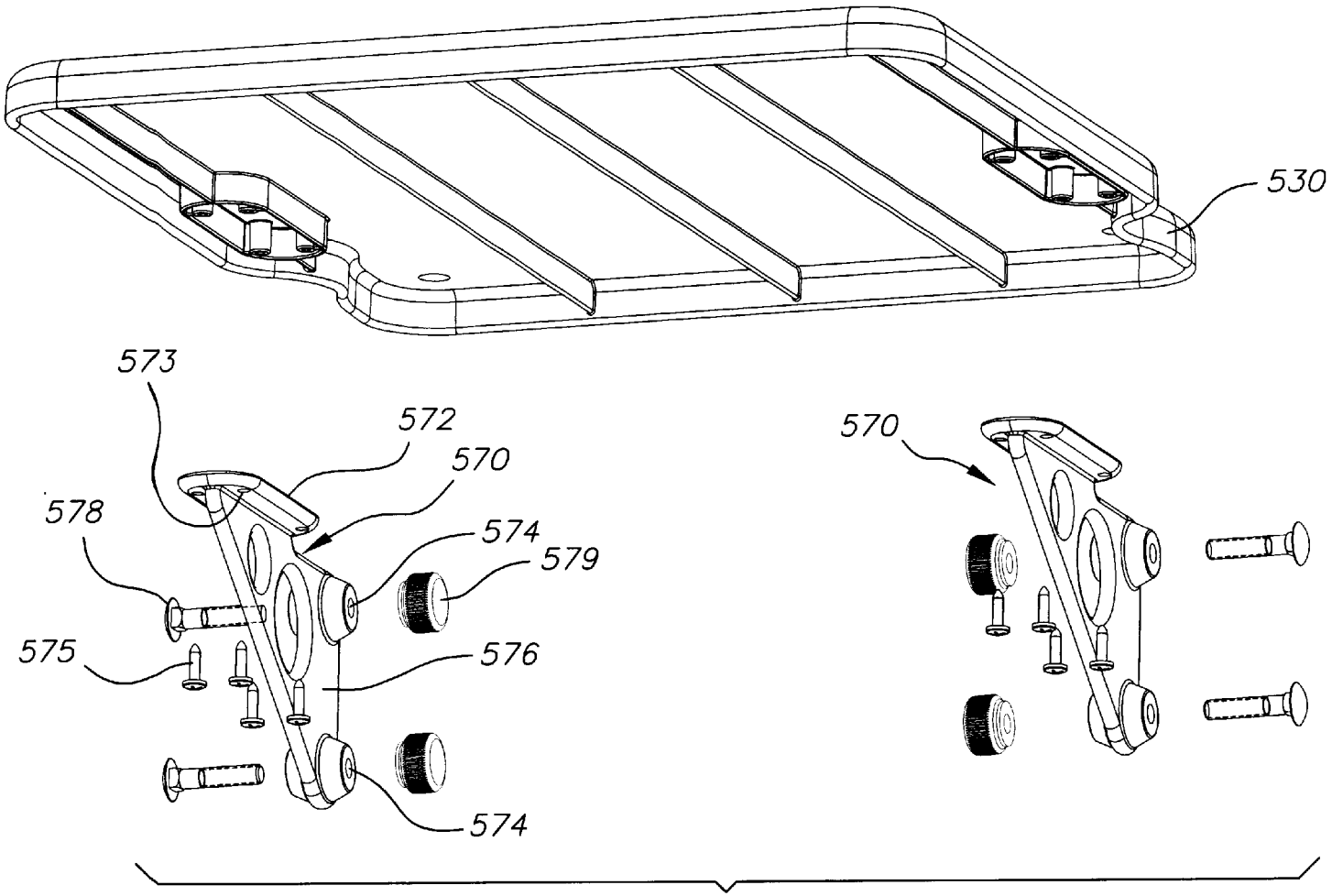
FIG. 14 shows an exploded perspective view of a shelf, a pair gussets, and means for securing the gusset to the shelf and rails.

Another fixture used with the present invention is the gusset 570, which is shown in FIGS. 11 and 14. The gusset 570 can be used as a support structure for holding other fixtures, such as the shelves 530, or can be designed to be a stand alone fixture. For example, in FIG. 11 the gusset 570 is shown supporting the shelves 530. This embodiment of the gusset if further shown in FIG. 14, wherein the gusset 570 comprises a support surface 572, a pair of mounting holes 574, and a gusset body 576, wherein the gusset is an integral unit having the gusset body 576 comprise most of the gusset 570. The support surface 572 comprises a generally flat surface that is adapted to allow another object, such as the shelf 530, to rest on the support surface, and can have holes 573 machined through it to allow screws 575 to connect the shelf to the gusset. Securing means are used to secure the gussets to the rails. The securing means shown in FIG. 14 is a plurality of carriage bolts 578 and locking knobs 579. The carriage bolts 578 slidably engage the grooves 120 of the rails and are disposed through the mounting holes 574 of the gusset. Once the desired position of the gusset along the rail has been determined, the gusset is secured to the rail by placing the locking knobs over the carriage bolts, which are adapted to matingly engage and secure the gusset between the rail the locking knobs. It is also understood that the mounting holes 574 are adapted to receive the clips 200, such that the clips are inserted through the mounting holes and secured to the rails 100 in the manner described above, and the gusset is secured to the rail by the clips and corresponding set screws. Although the gusset is shown as having a pair of mounting holes 574, and requiring a plurality of carriage bolts and locking knobs (or clips), it is understood that a single mounting hole 574 can be placed in the gusset body 576 to allow the gusset to be mounted to a rail.

The shelf 530 mounts between opposing grooves 120 of one or more rails 100 by attaching to a pair of gussets 570. As shown in FIGS. 11 and 14 each shelf 530 is mounted to a pair of gussets 570 and connected to the support surface 572 of each gusset by the screws 575. Thus, the shelves 530 are part of the category "fixtures 500" even though each shelf 530 first attaches to a separate fixture, namely the gusset 570, before attaching to grooved surfaces of the rail 100. Another structure for creating a shelf-like surface is to have the gusset 570 serve as the shelf by enlarging the support surface 572 to a size that can accommodate objects being placed on it. Therefore, the gusset 570 has a number of utilities, including attaching to different fixtures or by serving as a stand alone fixture.

Figure 15A:
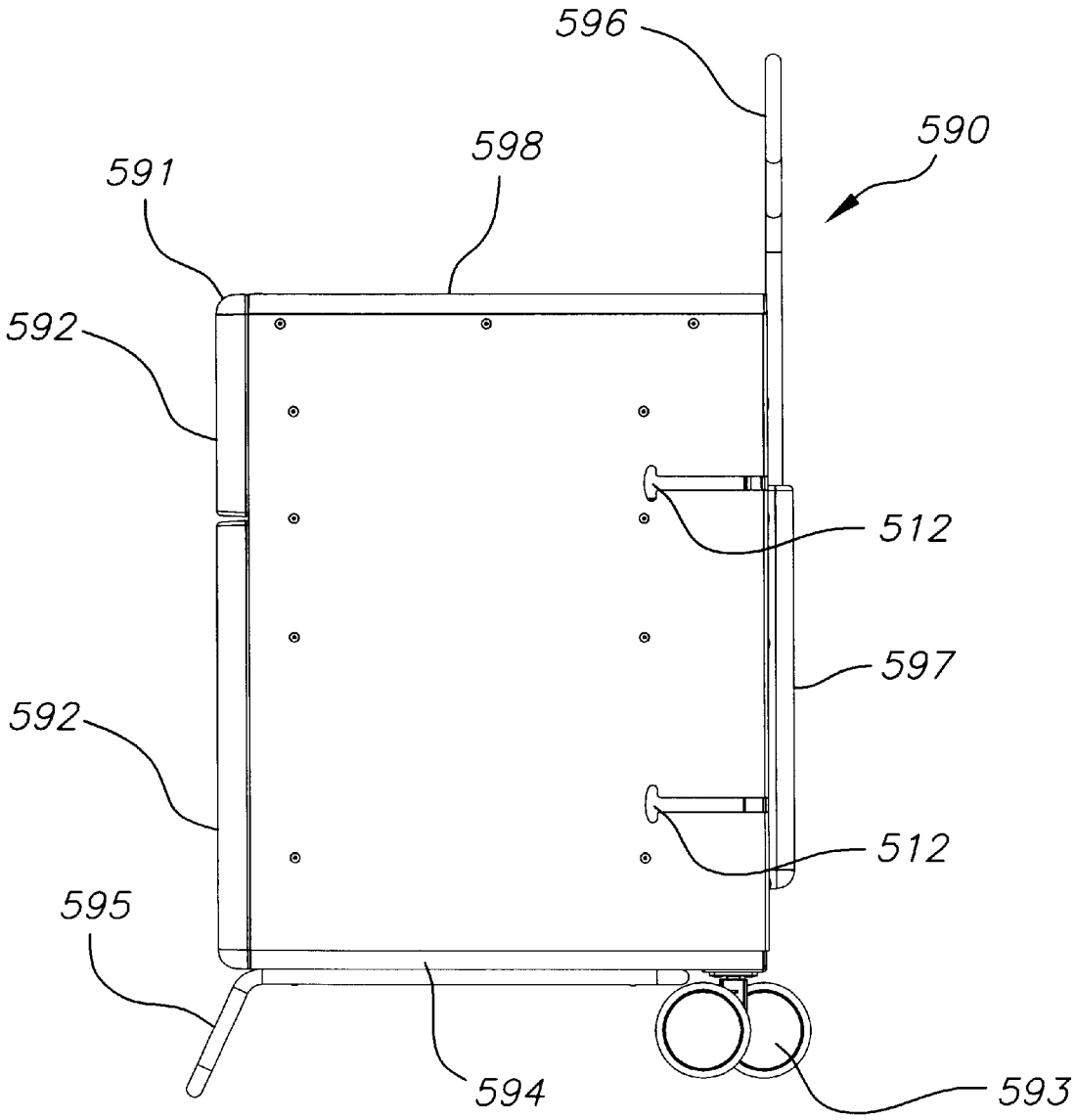
FIGS. 15*a–c* show side, front and rear perspective views of a pedestal.
Figure 15B:
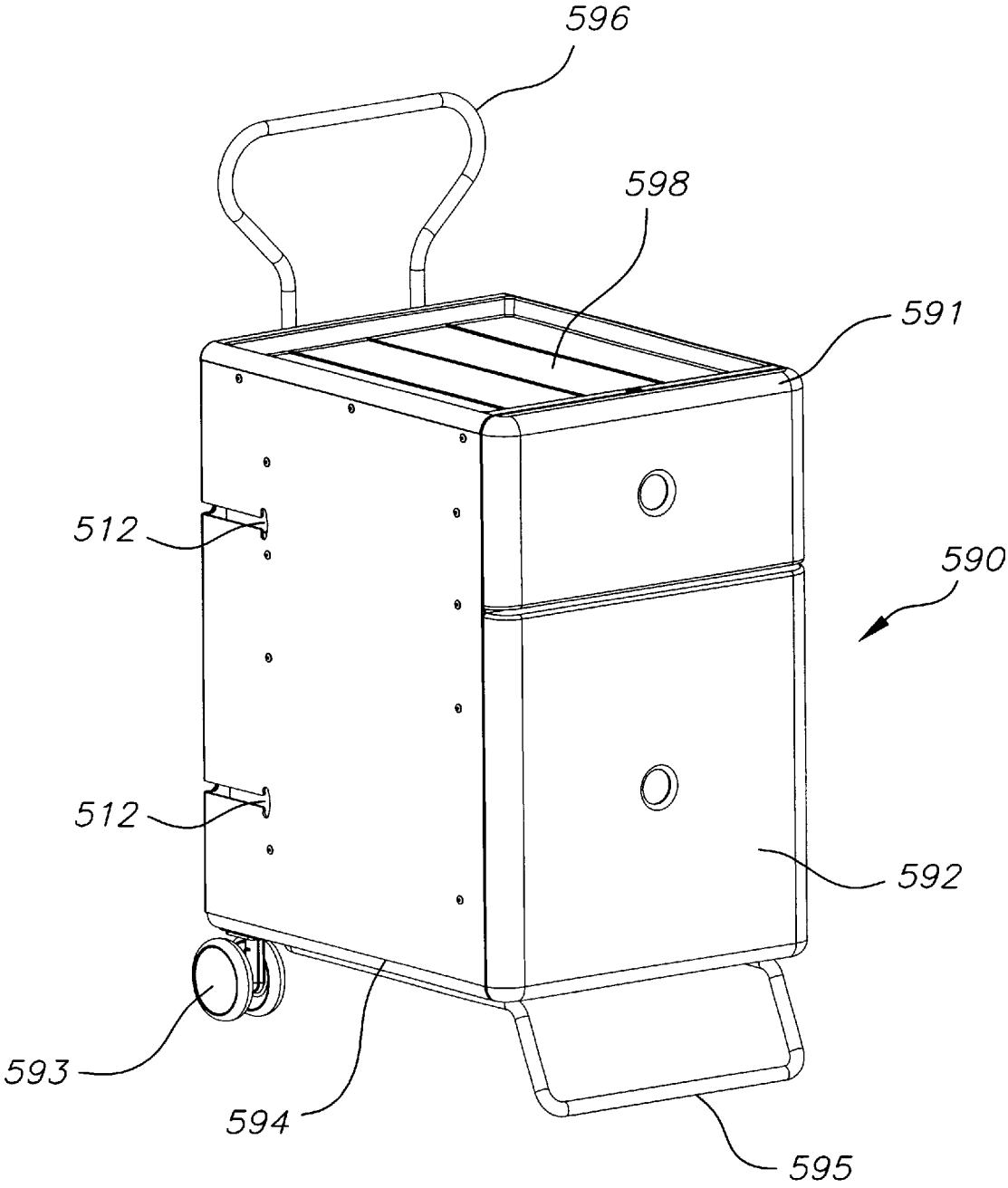
Figure 15C:
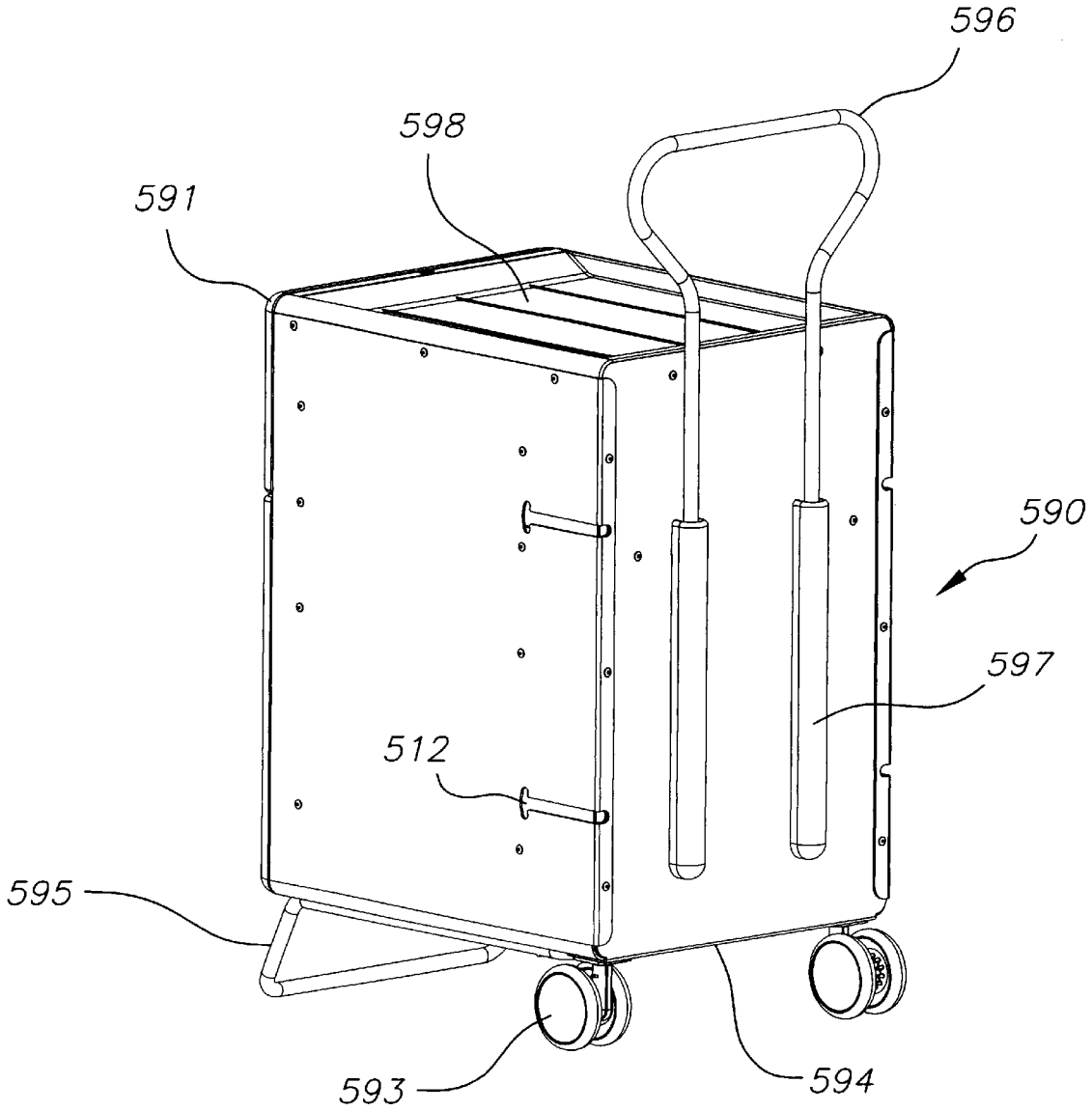

Another feature of the present furniture system includes a pedestal 590, which is shown in FIG. 15. The pedestal 590 can be mounted as part of the furniture system between rails 100 because it contains the requisite notches 512, or can be used independently as a mobile cabinet. The pedestal 590 overcomes disadvantages of known pedestal by providing a structure that prevents unwanted tipping when the pedestal drawers 592 are opened outward from the front face 591 of the pedestal. The problem of tipping in known pedestals, and known file cabinets, has only been solved by use of placing a heavy weighted object in the back portion of the pedestal, thereby counter-balancing the forward pulling force that results from a heavy top or bottom drawer being pulled open.

The present pedestal overcomes this problem with a footing 595 that extends from the bottom surface 594 of the pedestal and extends outward from the front face 591 of the pedestal. The footing 595 is cantilevered a predetermined distance from the bottom surface and front face of the pedestal. The distance the footing 595 extends depends upon the size of the pedestal, particularly the height and depth of the pedestal. The addition of the footing 595 to the bottom surface of the pedestal serves to move the fulcrum point of the pedestal towards the front of the pedestal, thereby allowing the pedestal to withstand greater loads in opened drawers without tipping. In addition, the pedestal 590 comprises a retractable handle 596 and one or more casters 593, which allow for easy movement of the pedestal. The handle 596 is shown extended above a top surface 598 of the pedestal, and is housed within a sheath 597 when the handle is not extended up. The casters 593 are placed on the bottom surface of the pedestal approximately opposite from the footing 595, at a position where the casters provide adequate support to prevent the pedestal from tipping when it is in a stationary position. The pedestal further has the feature of being mountable within the rails 100, because the pedestal has notches 512, similar to the box 510, such that the pedestal's position can be fixed within either the surface mounted or mobile furniture system.

Another feature of the present furniture system includes rail corner connector 700. Rail corner connector 700 is a device that connects two adjacent rails 100 together in a manner that gives the visual impression that the two rails 100 are a single, continuous rail. The rail corner connector 700 can be used to connect two rails 100, whose ends are positioned relative to one another at a variety of different angles. An example of the rail corner connector securing two rails together is shown in FIG. 18, wherein the rail corner connector 700 is comprised of two identical half pieces 750. One aspect of achieving the appearance of a single, uniform rail is to have the rail corner connector 700 dimensioned similar to the rails. The actual structure of the rail corner connector 700 will likely be quite different than the rails, but the outer appearance can be similar.

Figure 16:
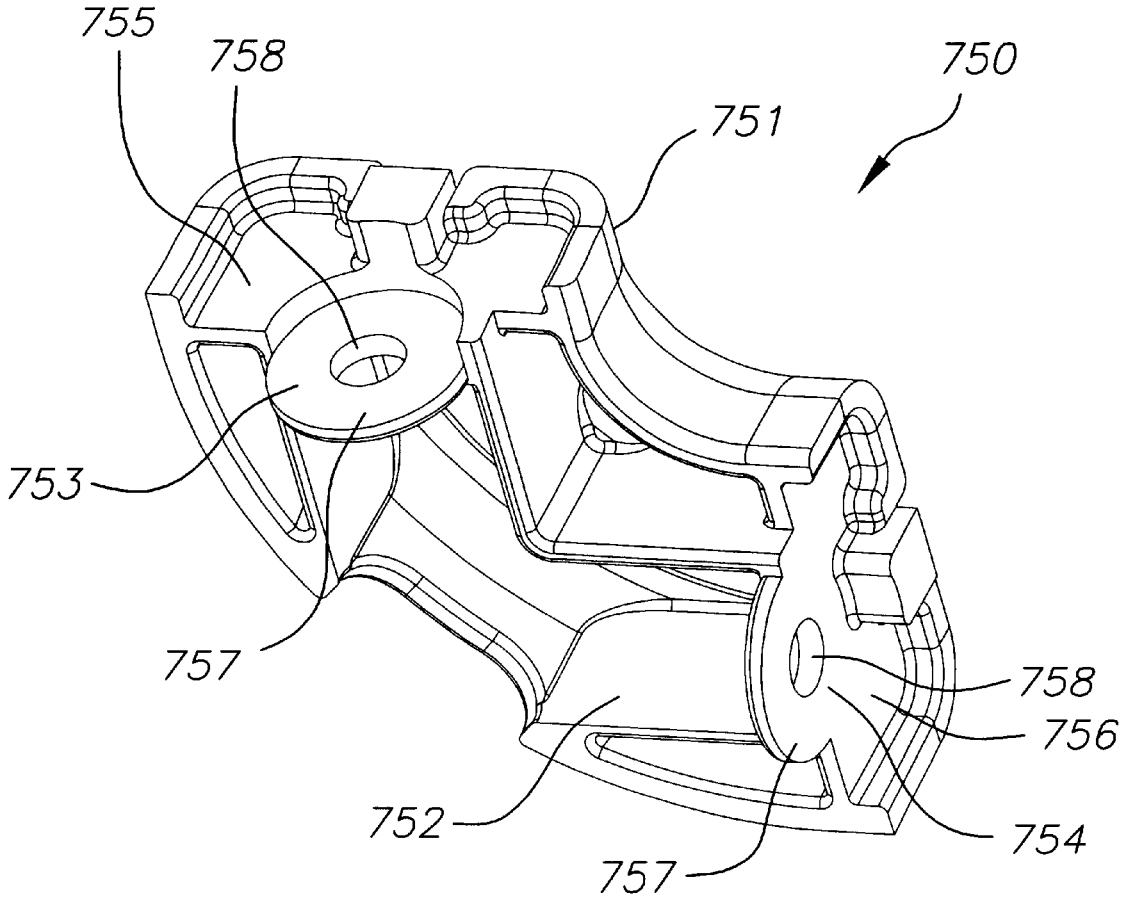
FIG. 16 shows a perspective view of an identical half piece used to form a rail corner connector.

Referring to FIGS. 16 and 17*a*–17*d*, the rail corner connector 700 comprises two identical half pieces 750 that interlock to form a single rail corner connector 700. FIG. 16 shows the half piece 750 which comprises an exterior side 751 and an interior side 752, and when the two half pieces are combined to form the rail corner connector 700, the interior sides of the two half pieces with by adjoining. Each half piece 750 further comprises a first screw mount 753 and a second screw mount 754, wherein the first and second screw mounts are positioned at opposite ends of the half piece 750 and extend from the interior side 752 of the half piece. The ends of the half piece 750 comprise a first outer face 755 and a second outer face 756 positioned opposite one another. The first screw mount 753 is positioned at the first outer face 755, and the second screw mount 754 is positioned at the second outer face 756. The first and second screw mounts 753, 754 each comprise an extended portion 757 which extends in the form of a half circle from the outermost portion of the interior side 752, and includes a hole 758 in its center. The extended portion 757 for the first screw mount 753 is set back a distance from the first outer face 755, and the extended portion 757 for the second screw mount 754 is set flush with the second outer face 756.

Figure 17A:
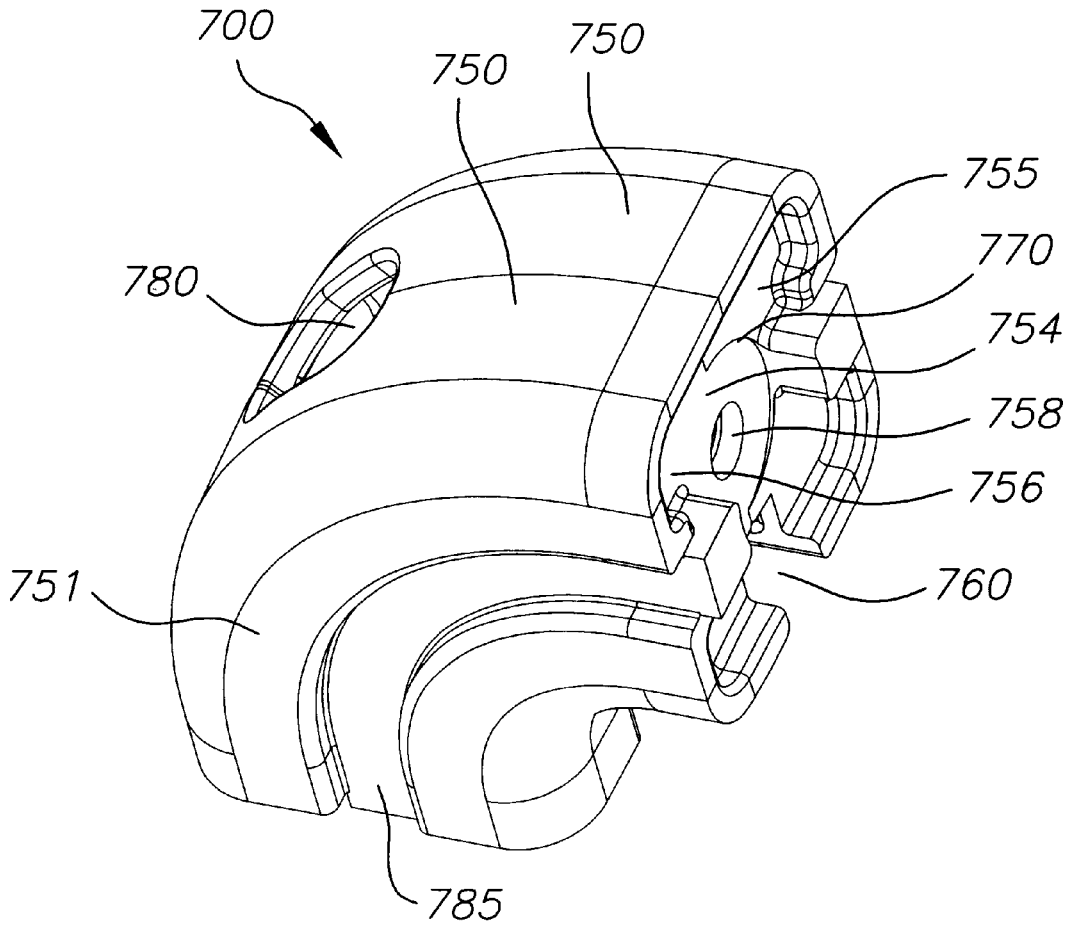
FIGS. 17*a–d* show different perspective views of the rail corner connector.
Figure 17B:
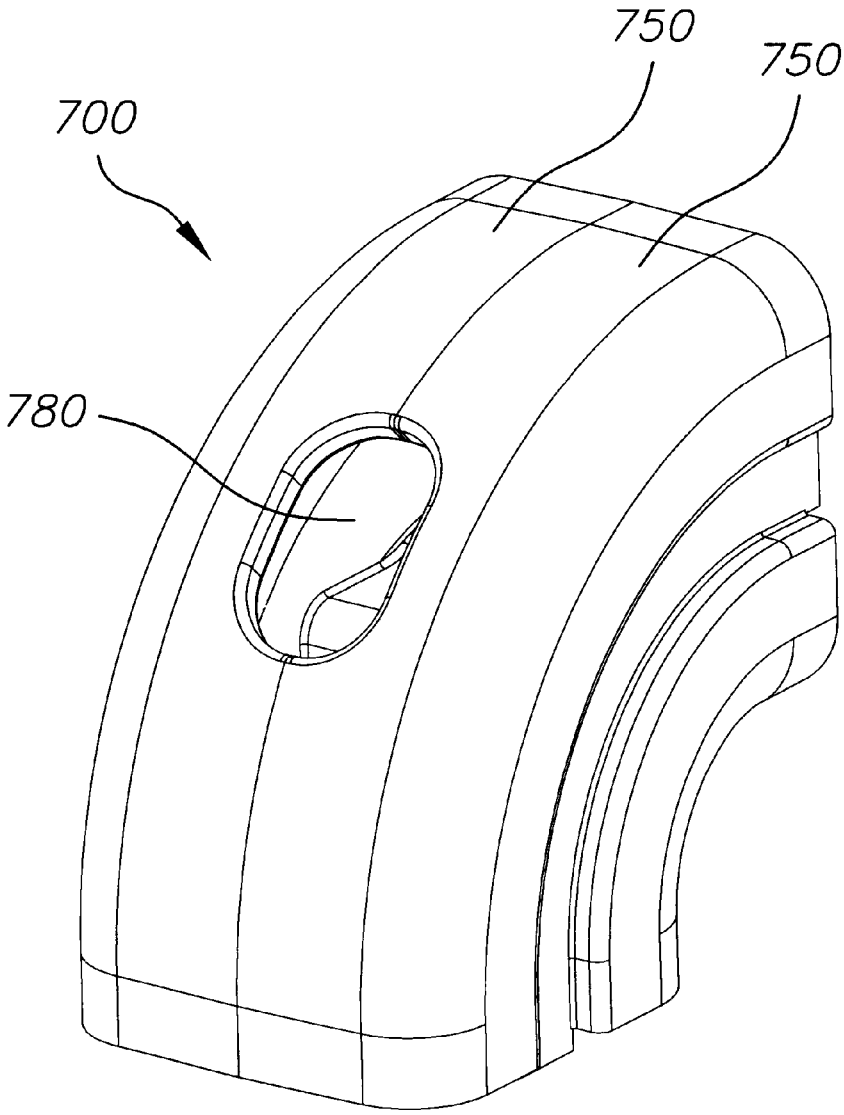

As shown in FIGS. 17*a*–17*d*, the two half pieces 750 interlock to form a single corner connector 700 by inversely flipping one of the half pieces relative to the other half piece, so that when combining the two halves the first screw mount 753 of one half is adjoining the second screw mount 754 of the other half. As shown in FIG. 17*a*, the first and second screw mounts of the two opposing halves combine to create a flush outer face 770 for the single corner connector 700. Further, it is shown that the second screw mount 754, which is set flush with the second outer face 756, is adjoined with the first outer face 755, wherein it is understood that the first screw mount 753 is resting below the second screw mount 754.

Figure 17C:
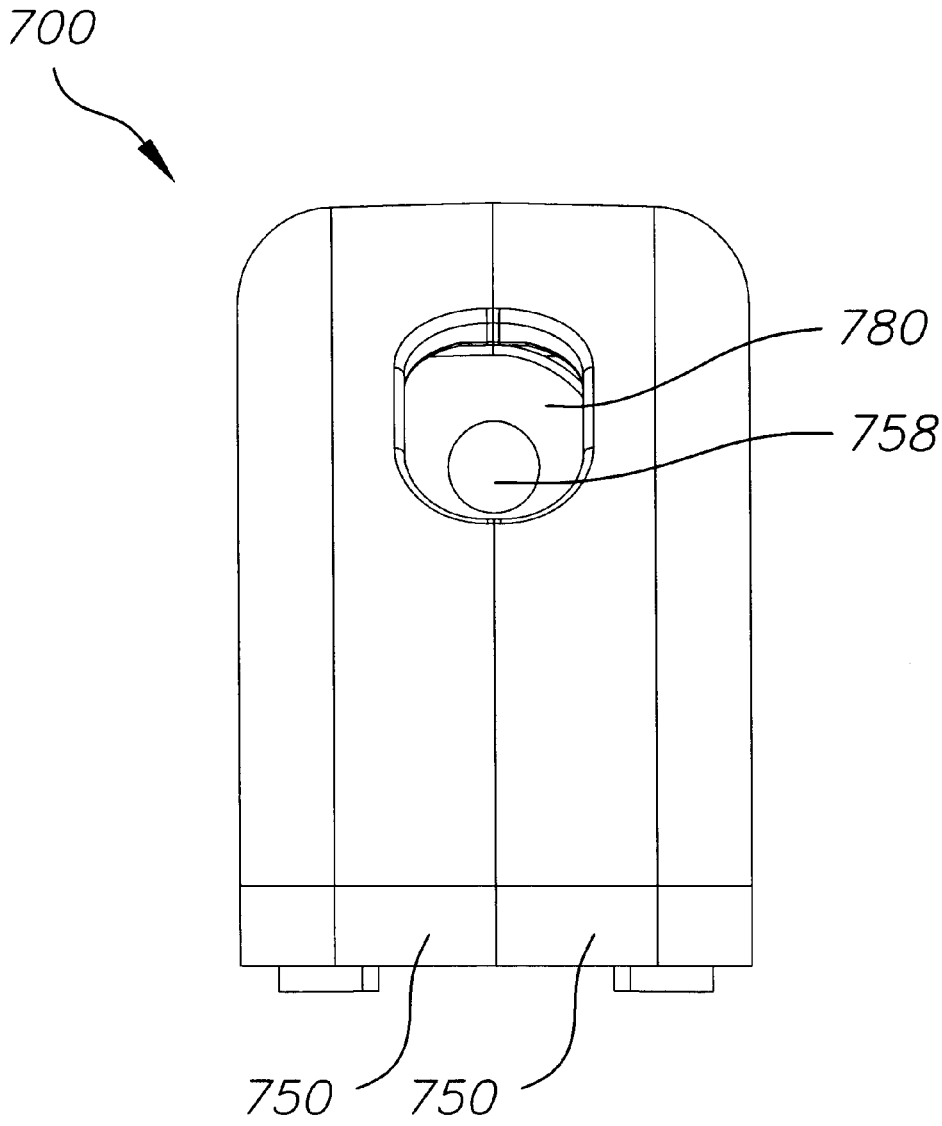
Figure 17D:
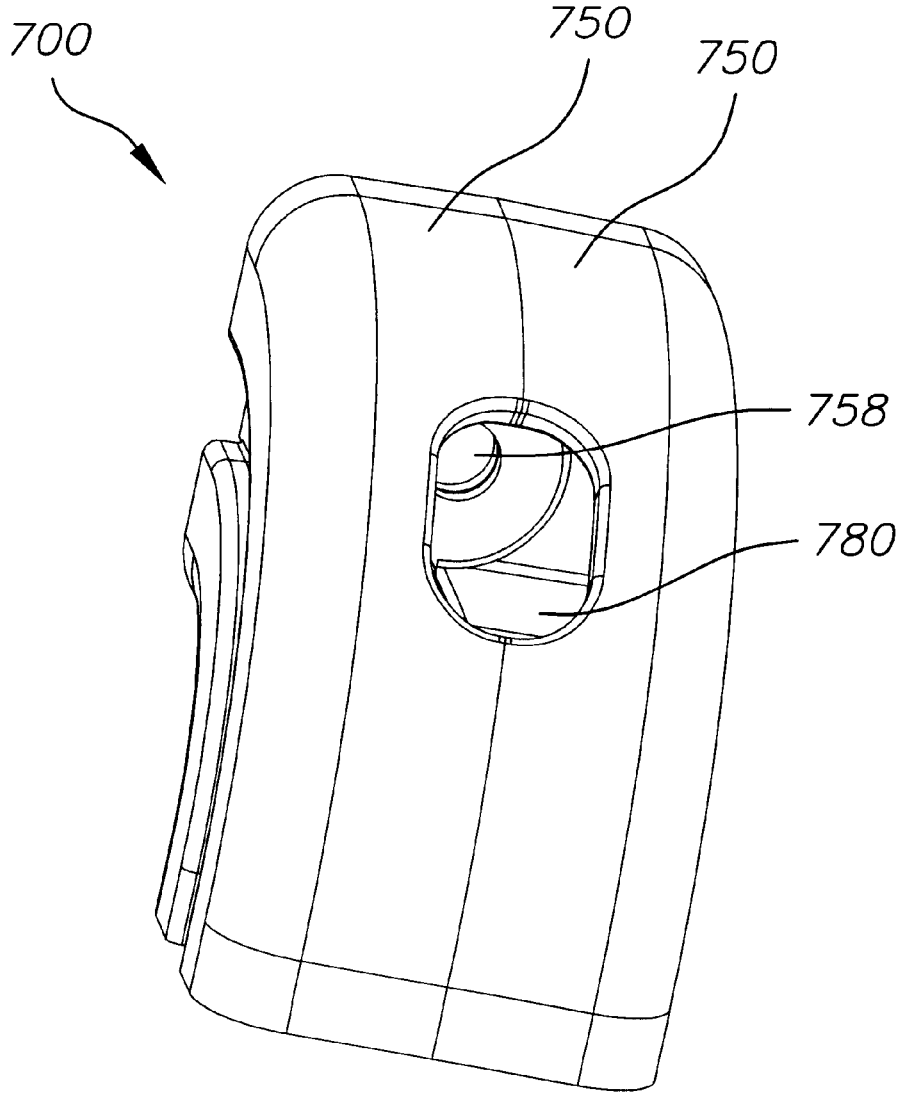

The thickness of each extended portion 757 is substantially equal to the distance that the first screw mount 753 is set back from the first outer face 755, which allows the second screw mount 754 to be positioned flush against the first screw mount 753, yet also create a flush outer face 770 for the newly combined corner connector 700. The interlocked extending portions 757 of the first and second screw mounts of the two half pieces 750 have the holes 758 of each extending portion aligned at the flush outer face 770 of the corner connector 700. The flush outer faces 770 are intended to adjoin end surfaces of rails 100, so that the corner connector and rail ends can create the appearance of a single rail. Because the flush outer faces 770 have holes 758, a screw or other suitable fastener can pass through the corner connector in order to secure the corner connector 700 to the rail 100. The ability to pass a screw through the corner connector is achieved by a window 780 which represents portions from each of the half pieces 750 where an indentation 782 (shown in FIG. 16) had been machined, or molded, into the outer surface of the interior side 752. The window 780 is positioned such that a line of sight is available from the window to the first and second screw mounts. The concept of the window 780 providing a line of sight is depicted in FIGS. 17*a* thru 17*d*, wherein the perspective view of the corner connector 700 in FIG. 27*a* is being rotated in a clockwise direction in FIGS. 17*b, c*, and *d*. In FIGS. 17*c* and *d*, the line of sight through window 780 to the holes 758 in the first and second screw mounts (which appear in FIG. 17*a* as the flush outer face 770) is evident. The window 780 is a sufficient size to allow passing of a screw therethrough to connect the corner connector 700 to a rail 100, wherein the point of connection with the rail is through the center extrusion 190 portion of the rail (shown in FIG. 4).

Figure 18B:
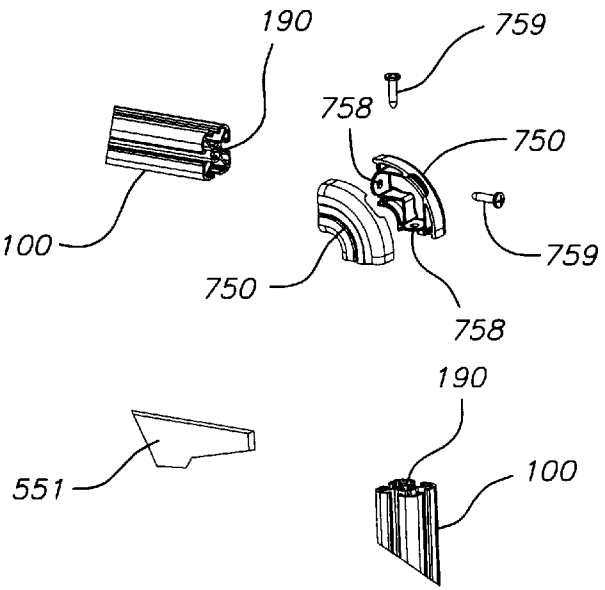
FIG. 18*b* shows a close-up, enlarged view of area 18*b* of FIG. 18*a*.
Figure 18A:
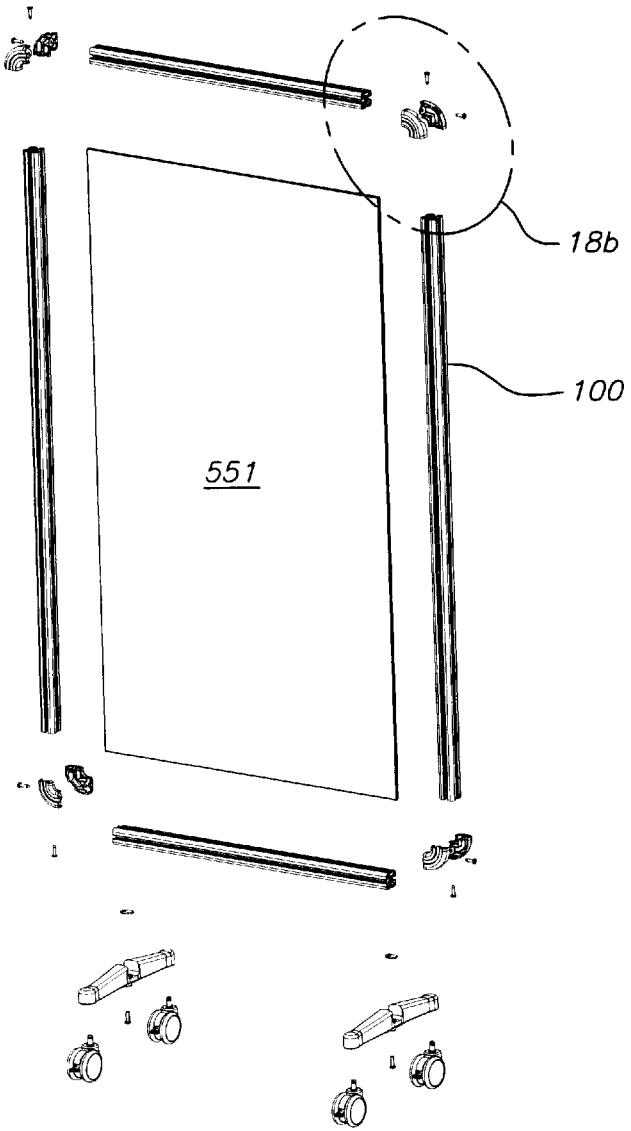
FIG. 18*a* shows an exploded perspective view of a lecture board secured within four rails which are interconnected by the rail corner connector.

The exterior side 751 of each half piece 750 of corner connector 700 can have a shallow groove 785 machined into it so that it will resemble the grooves 120 machined into the rails 100. Aside from the aesthetic appeal of having the corner connector closely resemble the dimensions of the rails 100, the corner connector can serve the function of holding fixtures. For example, the end of the corner connector opposite the window 780 can have a connector groove 760 (shown in FIG. 17*a*) which is again formed by the two half pieces 750. The use of the connector groove 760 to support a lecture board 551 is shown in FIGS. 18*a* and 18*b*, which also shows how corner connector 700 allows two rails to be joined in order to give the appearance of a single curved rail. Just as with the rails 100, the corner connector 700 can have any type of configuration as long as it cooperatively joins with rails 100. The connector 700 is joined to the rails 100 by the screws 759 which pass through the holes 758 in the connector and engage the center extrusion 190 of each of the rails being joined by the connector.

Figure 19:
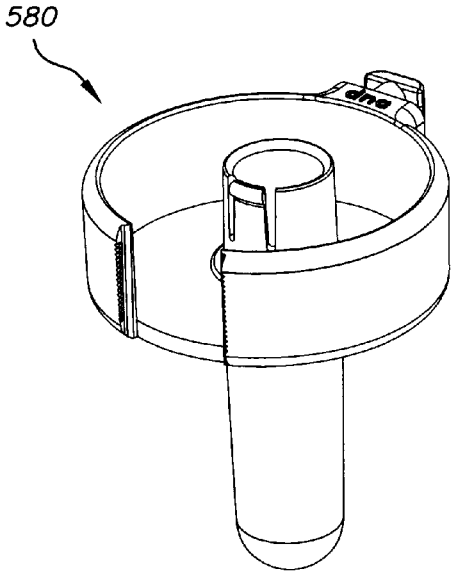
FIG. 19 shows a tape dispenser to be used with the present furniture system.
Figure 20:
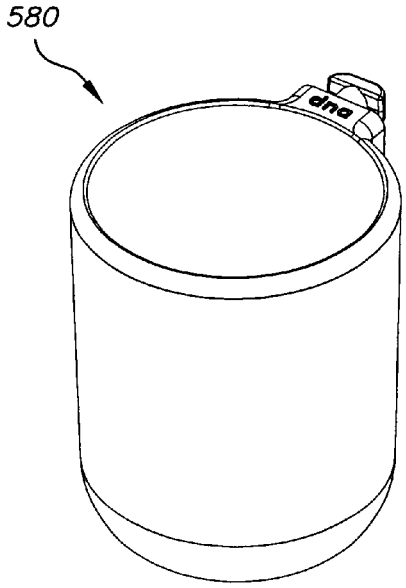
FIG. 20 shows a pencil holder to be used with the present furniture system.
Figure 21:
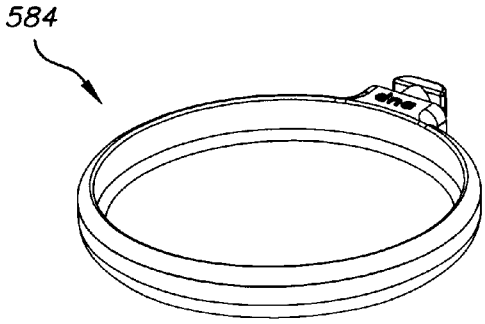
FIG. 21 shows a tray to be used with the present furniture system.
Figure 22:
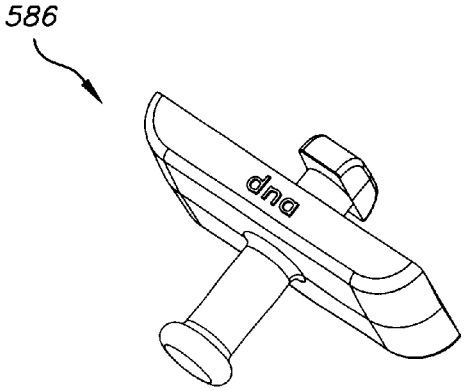
FIG. 22 shows a coat hook to be used with the present furniture system.
Figure 23:
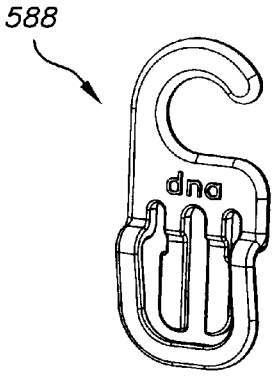
FIG. 23 shows a cd/document clip to be used with the present furniture system.
Figure 24:
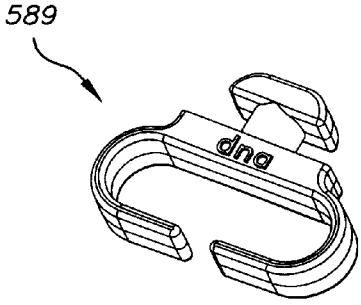
FIG. 24 shows a cable wallet to be used with the present furniture system.

Additional features of the present furniture system include various fixtures which can attach to rails 100 either directly by having an integral clip or by first connecting to one or more clips 200. For example, FIG. 19 shows a tape dispenser 580; FIG. 20 shows a pencil holder 582; FIG. 21 shows a tray 584; FIG. 22 shows a coat hook 586; FIG. 23 shows a cd/document clip 588, and FIG. 24 shows a cable wallet 589.

In addition to the specific features and embodiments described above in detail, it is understood that the present invention includes all equivalent structures to the structures described herein, and is not to be limited to the disclosed embodiments. For example, the scope of the present furniture system includes a single rail 100 having a curved shape wherein a single grooved surface 120 on the rail 100 has the appearance of two opposing grooved surfaces that are adapted to receive clips 200 and capable of supporting fixtures 500 therebetween. Further, the category "fixtures 500" includes fixtures that can be mounted to a single grooved surface 120 of a single rail 100 by a single clip 200. Individuals skilled in the art to which the present furniture system pertains will understand that variations and modifications to the embodiments described can be used beneficially without departing from the scope of the invention.

What is claimed is:

1. A modular and configurable furniture system comprising:

at least one rail having a first grooved surface and a second grooved surface positioned on a different exterior surface of the rail that cooperatively engages a surface mount assembly for securing the rail to a support surface;

at least one clip having a first end and a second end opposite the first end, the first end having two arms facing each other separated by a channel, the arms capable of being biased toward each other as the clip is inserted into the first grooved surface and maintains the clip in the first grooved surface after the clip is inserted;

a fastener dimensioned to pass into the channel to secure the clip to the rail; and at least one fixture mounted over the clip.

2. The furniture system of claim 1 wherein the channel is configured so that the arms expand against internal lips of the rail as the fastener extends into the channel.

3. The furniture system of claim 1, wherein the two arms of the clip comprise a first portion and second portion, the first portion having a tapered surface for inserting the arms into the first grooved surface and the second portion having a shoulder for slidably engaging internal lips of the first grooved surface.

4. The furniture system of claim 1, wherein at least one of the two arms of the clip includes a shoulder adapted to rest against internal lips of the first grooved surface so that the clip can slide within the first grooved surface of the rail.

5. The furniture system of claim 1, wherein the surface mount assembly comprises a mounting flange secured to the support surface, a stand-off positioned between the mounting flange and the rail, and a bolt for securing the stand-off to the grooved surface of the rail.

6. The furniture system of claim 1 further comprising at least one leg assembly for supporting a work surface mounted to the rail and the leg assembly.

7. The furniture system of claim 1 wherein the fixture is a storage box.

8. The furniture system of claim 1 wherein the fixture is a drawer.

9. The furniture system of claim 1 wherein the fixture is a hanging rod.

10. The furniture system of claim 1 wherein the fixture is a white board.

11. The furniture system of claim 1 wherein the fixture is a pin board.

12. The furniture system of claim 1 wherein the fixture is a gusset.

13. The furniture system of claim 1 further comprising a gusset and means for securing the gusset to the rail.

14. A modular and configurable furniture system comprising:

at least one rail having a grooved surface;

at least one clip adapted to cooperatively engage the grooved surface of the rail, the clip comprising:

a distal end and a proximal end opposite the distal end;

the distal end having two arms situated opposite each other and forming a channel therebetween;

the proximal end comprising a fixture holding rod having an internal passage extending into the channel;

a fastener dimensioned to pass through the internal passage and into the channel to secure the clip to the rail; and a fixture mounted over the fixture holding rod of the clip.

15. The furniture system of claim 14 wherein the channel is configured so that the arms expand against internal lips of the rail as the fastener extends into the channel.

16. The furniture system of claim 14, wherein the two arms of the clip comprise a first portion and second portion, the first portion having a tapered surface for inserting the arms into the grooved surface and the second portion having a shoulder for slidably engaging internal lips of the grooved surface.

17. The furniture system of claim 14, wherein at least one of the two arms of the clip includes a shoulder adapted to rest against internal lips of the grooved surface so that the clip can slide within the grooved surface of the rail.

18. The furniture system of claim 14, wherein the rail has a second grooved surface positioned on a different exterior surface of the rail that cooperatively engages a surface mount assembly for securing the rail to a support surface.

19. The furniture system of claim 18, wherein the surface mount assembly comprises a mounting flange secured to the support surface, a stand-off positioned between the mounting flange and the rail, and a bolt for securing the stand-off to the grooved surface of the rail.

20. The furniture system of claim 14 further comprising at least one leg assembly for supporting a work surface mounted to the rail and the leg assembly.

21. The furniture system of claim 14 wherein the fixture is a storage box.

22. The furniture system of claim 14 wherein the fixture is a drawer.

23. The furniture system of claim 14 wherein the fixture is a hanging rod.

24. The furniture system of claim 14 wherein the fixture is a white board.

25. The furniture system of claim 14 wherein the fixture is a pin board.

26. The furniture system of claim 14 wherein the fixture is a gusset.

27. The furniture system of claim 26 wherein the supports a shelf.

28. A furniture system comprising:

a plurality of rails;

means for securing a fixture to the rails; and at least one connector for adjoining two rails at end surfaces of the two rails, wherein the connector comprises two identical half pieces which combine to form the connector, each of the identical half pieces having a first screw mount and second screw mount extending from an interior side of the half pieces and positioned at opposite ends of each of the half pieces, wherein the first screw mount of one identical half piece adjoins the second screw mount of the other identical half piece, and wherein the rail connector has an exterior dimension similar to the rails and when secured between the end surfaces of the two rails creates an appearance of a single continuous rail.

29. The furniture system of claim 28 wherein the connector further includes a window for access to the first screw mount and the second screw mount.

* * * * *

UNITED STATES PATENT AND TRADEMARK OFFICE

CERTIFICATE OF CORRECTION

PATENT NO. : 6,726,034 B2
DATED : April 27, 2004
INVENTOR(S) : Holbrook et al.

It is certified that error appears in the above-identified patent and that said Letters Patent is hereby corrected as shown below:

Column 14,
Line 35, after "wherein the", insert -- gusset --

Signed and Sealed this

Ninth Day of August, 2005

JON W. DUDAS
*Director of the United States Patent and Trademark Office*

UNITED STATES PATENT AND TRADEMARK OFFICE

CERTIFICATE OF CORRECTION

PATENT NO. : 6,726,034 B2
DATED : April 27, 2004
INVENTOR(S) : Holbrook et al.

It is certified that error appears in the above-identified patent and that said Letters Patent is hereby corrected as shown below:

Title page,
Item [73] Assignee, delete "Toronto (CA)", insert -- Mount Laurel (NJ) --.

Signed and Sealed this

Fifteenth Day of November, 2005

JON W. DUDAS
*Director of the United States Patent and Trademark Office*